US005512983A

United States Patent [19]

Fukushima et al.

[11] Patent Number: 5,512,983

[45] Date of Patent: Apr. 30, 1996

[54] ELECTROPHOTOGRAPHING APPARATUS WITH FIRST AND SECOND CHARGE DEVICES

[75] Inventors: Satoru Fukushima, Kawasaki; Makoto Ohki, Yokohama, both of Japan

[73] Assignee: Canon Kabushiki Kaisha, Tokyo, Japan

[21] Appl. No.: 267,902

[22] Filed: Jul. 6, 1994

[30] Foreign Application Priority Data

Jul. 8, 1993 [JP] Japan ..... 5-193078

[51] Int. Cl.[6] ..... G03G 15/24

[52] U.S. Cl. ..... 355/220; 355/219; 355/274

[58] Field of Search ..... 355/200, 203, 355/204, 208, 210, 219, 220, 271, 272, 273, 274, 311

[56] References Cited

U.S. PATENT DOCUMENTS

| | | | |
|---|---|---|---|
| 4,786,942 | 11/1988 | Kusumoto et al. | 355/208 |
| 4,821,068 | 4/1989 | Honma et al. | 355/208 |
| 5,006,893 | 4/1991 | Yokoyama | 355/208 |
| 5,053,814 | 10/1991 | Takano et al. | 355/208 |
| 5,083,167 | 1/1992 | Fukushima et al. . | |
| 5,170,210 | 12/1992 | Saruwatari | 355/208 |
| 5,194,901 | 3/1993 | Fukushima et al. . | |
| 5,357,319 | 10/1994 | Nagashima | 355/208 |

*Primary Examiner*—Sandra L. Brase
*Attorney, Agent, or Firm*—Fitzpatrick, Cella, Harper & Scinto

[57] ABSTRACT

This invention relates to an electrophotography apparatus with a photosensitive body, first charge devices for performing a first charge process to form an image on the photosensitive body, a transfer charger for transferring the image formed on the photosensitive body onto a transfer material, and potential applying device for setting the photosensitive body at a predetermined potential by simultaneously performing a second charge process having the same polarity as a polarity of the first charge process and a full-surface exposure process on the photosensitive body, after the image is transferred by the transfer charger and before the first charge process is performed by the first charge device.

18 Claims, 19 Drawing Sheets

ELECTROPHOTOGRAPHING APPARATUS WITH FIRST AND SECOND CHARGE DEVICES

BACKGROUND OF THE INVENTION

1. Field of the Invention

The present invention generally relates to an electrophotography type image forming apparatus and, more particularly, to an image forming apparatus which can be suitably applied to various types of color copying machines such as a multi-color electrophotography copying apparatus comprising a plurality of developers; a recording apparatus constituting an output unit of a facsimile machine, a computer, or the like; a color printer, and the like.

2. Related Background Art

FIG. 14 is a schematic side view of a conventional multi-color electrophotography copying apparatus. Referring to FIG. 14, after the surface of a photosensitive drum 51 is charged by a primary charger 52, an optical image is exposed on the surface of the drum 51, thus forming an electrostatic latent image. The electrostatic latent image is developed by a toner, and the toner image on the photosensitive drum is transferred onto a transfer material P carried on a transfer drum 55 by a transfer charger 55*b*. After the transfer operation, the transfer material is subjected to electricity removal by electricity removal chargers 55*d* and 55*e*.

Although the multi-color electrophotography copying apparatus with the above-mentioned arrangement operates very well, the present inventors found from the results of their studies and experiments that a problem was posed in the transfer process, especially when a polyvinylidene chloride resin film or the like is used as a transfer material carrier sheet 501 of the transfer drum 55, and a transfer paper sheet is used as the transfer material P, or especially when the humidity is high.

FIG. 16 is an explanatory view showing the state of electric charges on an end portion, in particular, a trailing end portion Pa, of the transfer material P on the transfer unit of a transfer device 55A. Although a toner image of one color has already been transferred onto the transfer material P on the transfer drum 55, the transfer material P is kept wound around the transfer drum 55 without being separated therefrom, and is rotated together with the transfer drum 55 so as to transfer a toner image of the next color thereon. The polarity of a transfer voltage to be supplied to the transfer charger 55*b* is set to be plus (positive) when, for example, an electrostatic latent image is formed by minus (negative) electric charges, and the toner particles of a developing agent in each developing device are charged to have minus polarity so as to reverse and develop the latent image.

The present inventors found from the results of their studies and experiments that when a polyvinylidene chloride resin film was used as the transfer material carrier sheet 501 and a transfer paper sheet was used as the transfer material P, since the volume resistance of the polyvinylidene chloride resin film was $10^{13}$ Ωcm and the volume resistance of the transfer paper sheet was $10^{9}$ Ωcm (at high humidity) to $10^{12}$ Ωcm (at low humidity), plus electric charges from the transfer charger 55*b* were injected into the transfer material P via the transfer material carrier sheet 501 and were accumulated in the surface area of the transfer material P.

Also, the present inventors learned the following fact. That is, the plus electric charges accumulated in the surface area of the transfer material P generated a high electric field between themselves and the surface of the photosensitive drum 51, and caused peeling discharge when the transfer material P was separated from the photosensitive drum 51, as shown in FIG. 17. Minus electric charges generated in the air due to the peeling discharge moved onto the transfer material P while being attracted by the plus electric charges of the transfer material P, but plus electric charges in the air moved onto the photosensitive drum 51 which was charged to have minus electric charges, thus damaging the photosensitive drum 51, i.e., generating a memory on the drum 51.

The memory decreases the primary charge amount on the photosensitive drum 51 by the primary charger 52 in a stripe shape in the axial direction of the photosensitive drum 51, and consequently disables primary charging of the photosensitive drum 51, thus causing a considerable image defect. The above-mentioned memory is mainly generated in correspondence with the operation of the transfer charger 55*b*. As shown in FIG. 16, the plus electric charges are easily accumulated especially on the end portion Pa of the transfer material P, strongly generate a memory consequently, and form strong stripe-shaped image nonuniformity in the axial direction of the photosensitive drum 51.

For the purpose of eliminating the memory, another charger (not shown) is arranged at the output side of the transfer charger 55*b* to perform electricity removal of the memory area on the photosensitive drum 51 after the transfer process, or the photosensitive drum 51 is subjected to electricity removal exposure and primary charge processes to pre-charge the drum 51 to have the same polarity as that obtained by the primary charge process so as to sufficiently eliminate the memory area. However, a sufficient effect cannot be obtained by only electricity removal. On the other hand, when the drum 51 is charged to have the same polarity as that obtained by the primary charge process, the elimination effect of the memory area is observed. However, in this case, since residual toner particles on the photosensitive drum 51 are also charged, they often cause a cleaning error.

When the photosensitive drum 51 is pre-charged to have the same polarity as that obtained by the primary charge process, the drum 51 must be charged to have a considerably high potential so as to sufficiently eliminate the memory generated on the end portion Pa of the transfer material P. In such a case, an image defect is often generated due to dielectric breakdown of the photosensitive drum 51. Furthermore, an extra space is required. More specifically, since a conventional transfer operation is performed in a state wherein the photosensitive drum 51 contacts the transfer material P, there is no effective means for eliminating the memory generated on the photosensitive drum 51 and, more particularly, the strong memory generated on the area corresponding to the end portion Pa of the transfer material without causing a cleaning error, dielectric breakdown of the photosensitive drum 51, and the like and without requiring an extra space.

SUMMARY OF THE INVENTION

It is an object of the present invention to provide an electrophotographing apparatus which can prevent image nonuniformity by removing a memory generated on a photosensitive body.

It is another object of the present invention to provide an electrophotographing apparatus which can remove a memory generated on a photosensitive body without causing a cleaning error.

It is still another object of the present invention to provide an electrophotographing apparatus, which can suppress production of discharge products such as $O_3$, $NO_x$, and the like due to an auxiliary charge process performed upon removal of the memory, so as to prevent exposure and degradation of a photosensitive body due to the discharge products, pollution of the environment by the discharge products, and the like, and which can suppress a considerable change in light attenuation characteristics of the photosensitive body due to full-surface exposure to be performed simultaneously with the auxiliary charge process, so as to prevent deterioration of image quality caused by the change.

Other objects and features of the present invention will become apparent from the following detailed description taken in conjunction with the accompanying drawings.

DETAILED DESCRIPTION OF THE PREFERRED EMBODIMENTS

The preferred embodiments of the present invention will be described hereinafter with reference to the accompanying drawings.

First Embodiment

Figure 1:
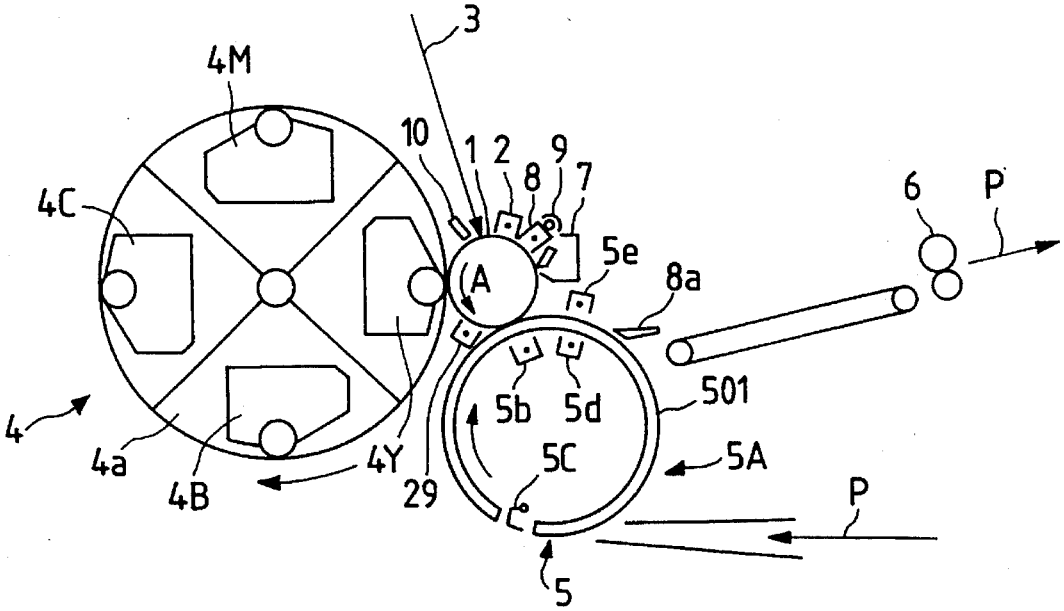
FIG. 1 is a schematic view showing the first embodiment of an image forming apparatus according to the present invention.

FIG. 1 is a schematic view showing a multi-color electrophotographing copying apparatus as the first embodiment of an electrophotographing apparatus according to the present invention.

As shown in FIG. 1, the multi-color electrophotographing copying apparatus comprises an image carrier (photosensitive drum) 1 which is rotatably and axially supported, and is rotated in the direction of an arrow A, and an image forming means is arranged around the outer circumferential surface of the drum 1. The image forming means can comprise arbitrary means. In this embodiment, the image forming means comprises a primary charger 2 for uniformly charging the surface of the photosensitive drum 1, an exposure means 3 such as a laser beam exposure device for radiating an optical image obtained by color-separating a color image or a corresponding optical image onto the photosensitive drum 1 and forming an electrostatic latent image of the optical image, and a rotary developing device 4 for visualizing the electrostatic latent image on the photosensitive drum 1 as a toner image.

The rotary developing device 4 is constituted by holding four developers 4Y, 4M, 4C, and 4B, which respectively store yellow, magenta, cyan, and black developing agents, around a substantially columnar housing **4*a*, which is rotatably and axially supported. The rotary developing device 4 conveys the developer which stores a color developing agent corresponding to the electrostatic latent image formed on the photosensitive drum 1 to a developing position facing the outer circumferential surface of the photosensitive drum 1 upon rotation of the housing 4*a*, and develops the electrostatic latent image on the photosensitive drum 1 by the color developing agent to visualize it as a toner image. The developing device 4** repeats this operation for other colors to achieve full-color development for four colors.

The toner image formed on the photosensitive drum 1 is transferred by a transfer device 5A onto a transfer material P carried on the transfer device 5A. In this embodiment, the transfer device 5A is of a drum type comprising a transfer drum 5 which is rotatably and axially supported. As can be understood from FIG. 15, the transfer drum 5 is constituted by extending a transfer material carrier or bear sheet (transfer material carrier member) 501 on the outer circumferential surface of a blank area between a pair of cylinders 5*a* arranged at two ends. The transfer material carrier sheet 501 normally consists of a dielectric film such as a polyethylene terephthalate resin film, polyvinylidene chloride resin film, or the like. Transfer material grippers 5*c* for gripping the transfer material P fed from a paper feed device (not shown) are arranged on a non-extending portion of the transfer material carrier sheet 501 on the outer circumferential surface of the transfer drum 5, and a transfer charger 5*b* constituting a transfer means is arranged in the transfer drum 5. Furthermore, inner and outer electricity removal chargers 5*d* and 5*e* constituting electricity removal means are arranged on the inner and outer sides of the transfer drum 5, as shown in FIG. 1.

A full-color image forming process by the multi-color electrophotography copying apparatus with the above-mentioned arrangement will be briefly described below.

By activating the primary charger 2 and the exposure means 3, a blue color-separated electrostatic latent image is formed on the outer circumferential surface of the photosensitive drum 1, and is developed with the yellow developing agent by the developer 4Y in the rotary developing device 4. On the other hand, a transfer material P fed to the transfer device 5A is gripped by the grippers 5*c* on the transfer drum 5, and is brought into contact with the toner image formed on the photosensitive drum 1 upon rotation of the transfer drum 5. The toner image is transferred onto the transfer material P upon operation of the transfer charger 5*b*, and at the same time, the transfer material P is attracted and held on the transfer material carrier sheet 501.

When the above-mentioned image forming and transfer operations are repeated for magenta, cyan, and black, an image formed by transferring four color toner images to overlap each other is obtained on the transfer material P. The transfer material P on which the four color toner images have been transferred is subjected to electricity removal by the inner and outer chargers 5*d* and 5*e*, and is peeled from the transfer drum 5 by a peeling pawl 8*a*. Then, the image formed on the transfer material P is fixed by melting and mixing the four color toner images by a thermal fixing roller 6. Thereafter, the transfer material P is exhausted outside the copying apparatus.

On the other hand, the residual toner particles on the photosensitive drum 1 are removed by a cleaner 7 to prepare for the next image forming process.

Since the arrangement and operation of this multi-color electrophotography copying apparatus are basically as described above, a detailed description thereof will be omitted. In this embodiment, the diameter of the photosensitive drum 1 is set to be 80 mm, and the diameter of the transfer drum 5 of the transfer device 5A is set to be twice that of the photosensitive drum 1, i.e., 160 mm. The photosensitive drum 1 is rotated in the direction of the arrow in FIG. 1 at 160 mm/sec, and its surface is charged to −300 to −900 V by the primary charger 2. The surface potential of the photosensitive drum 1 is monitored by a drum surface potential sensor 10, and a proper surface potential of the photosensitive drum 1 is calculated. The exposure means 3 adopts a laser beam exposure device. The photosensitive layer of the photosensitive drum adopts an organic photoconductive layer which is charged to have negative polarity.

Each of the color developers of the rotary developing device 4 has a minus-charged color toner. The toner is attached to an electrostatic latent image formed on the photosensitive drum 1 by reversal development by a developing electric field formed by a voltage (developing bias) applied to a developing sleeve which carries the toner and conveys it to a developing area close to the photosensitive drum 1, and the surface potential of the photosensitive drum 1, thereby visualizing the latent image as a toner image.

Figure 15:
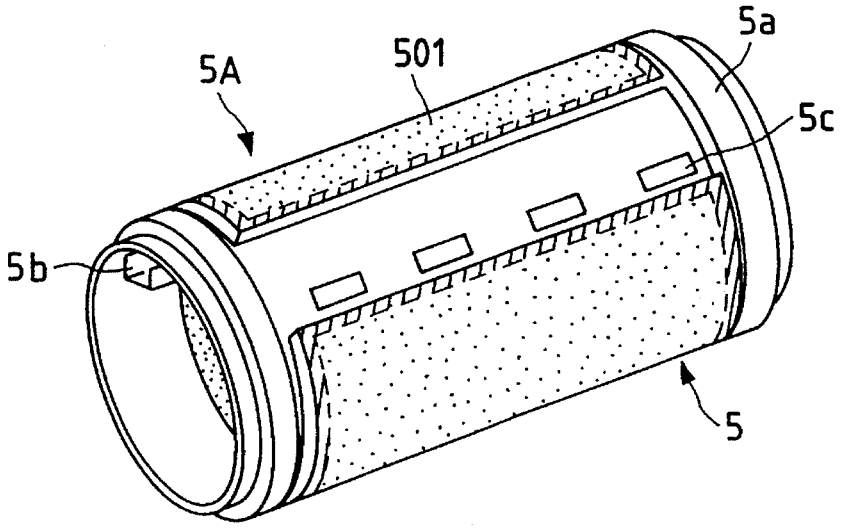
FIG. 15 is a perspective view showing a transfer drum of a transfer device used in the image forming apparatus shown in FIG. 14.
Figure 16:
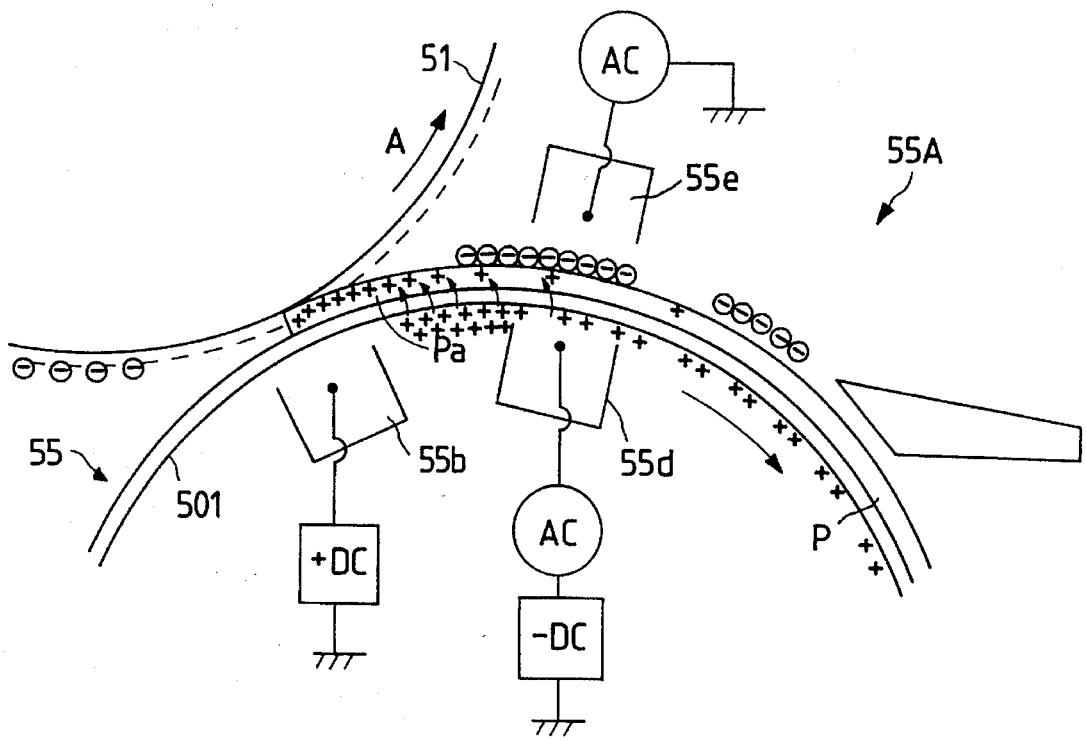
FIG. 16 is an explanatory view showing the state of charges on the end portion of a transfer material on a transfer unit of the transfer device shown in FIG. 15.
Figure 17:
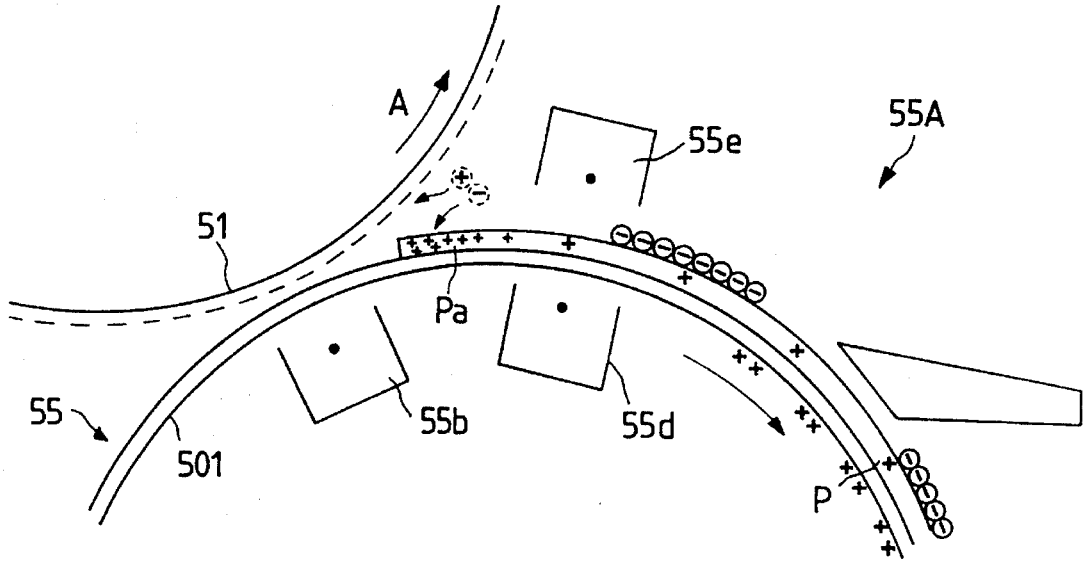
FIG. 17 is an explanatory view showing peeling discharge at the end portion of the transfer material.

As can be understood from FIG. 1, the transfer device comprises the same drum type transfer device 5A comprising the transfer drum 5 as that shown in FIG. 15. As the transfer material carrier sheet 501 of the transfer drum 5, a polyvinylidene chloride resin dielectric film having a thickness of 100 to 175 μm and a volume resistance of $10^{13}$ Ωcm is used. Also, the transfer charger 5*b* comprises a corona charger. In this embodiment, a voltage of + 6 kV to +9 kV is applied to a corona wire to set a transfer current to be applied to the corona wire to be +100 μA to +500 μA. The toner image on the photosensitive drum 1 is transferred onto the transfer material P which is carried and conveyed by the transfer drum 5.

Figure 13:
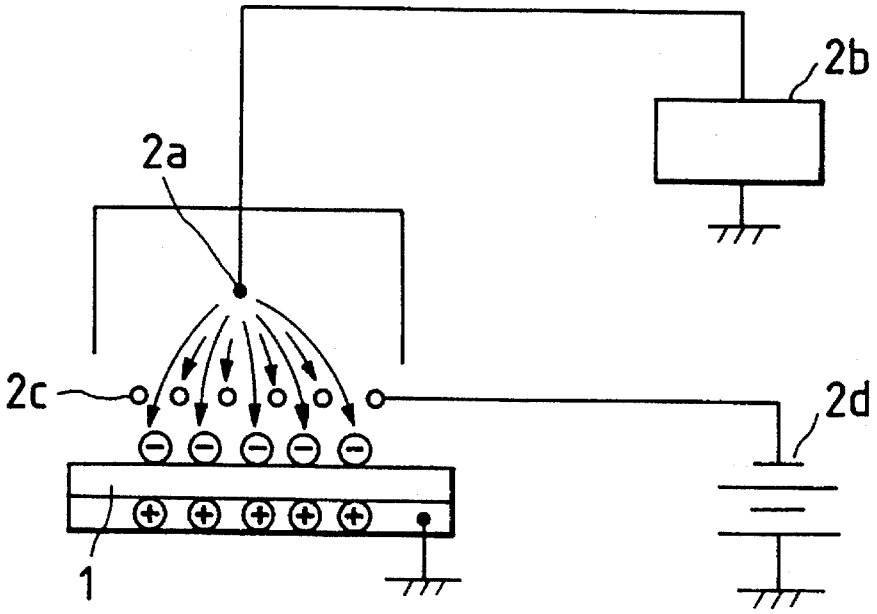
FIG. 13 is a sectional view showing a scorotron type charger as an auxiliary charger which can be used in the present invention.
Figure 14:
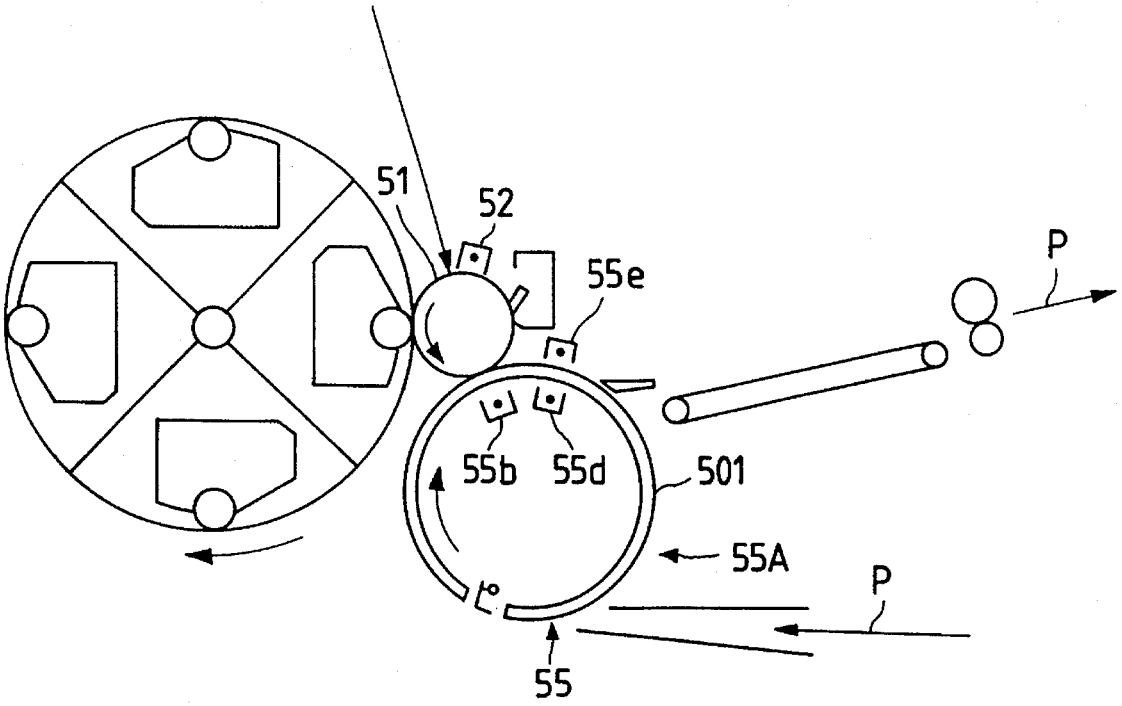
FIG. 14 is a schematic view showing an example of a conventional image forming apparatus.

Furthermore, in this embodiment, the primary charger 2 comprises a scorotron type charger, as shown in FIG. 13. The discharge amount of a charge wire 2*a* which discharges in correspondence with a high voltage applied from a high-voltage power supply 2*b* is controlled by applying a predetermined control voltage from a grid bias power supply 2*d* to a grid wire 2*c*, thereby charging the surface of the photosensitive drum 1 at a desired potential.

Figure 2:
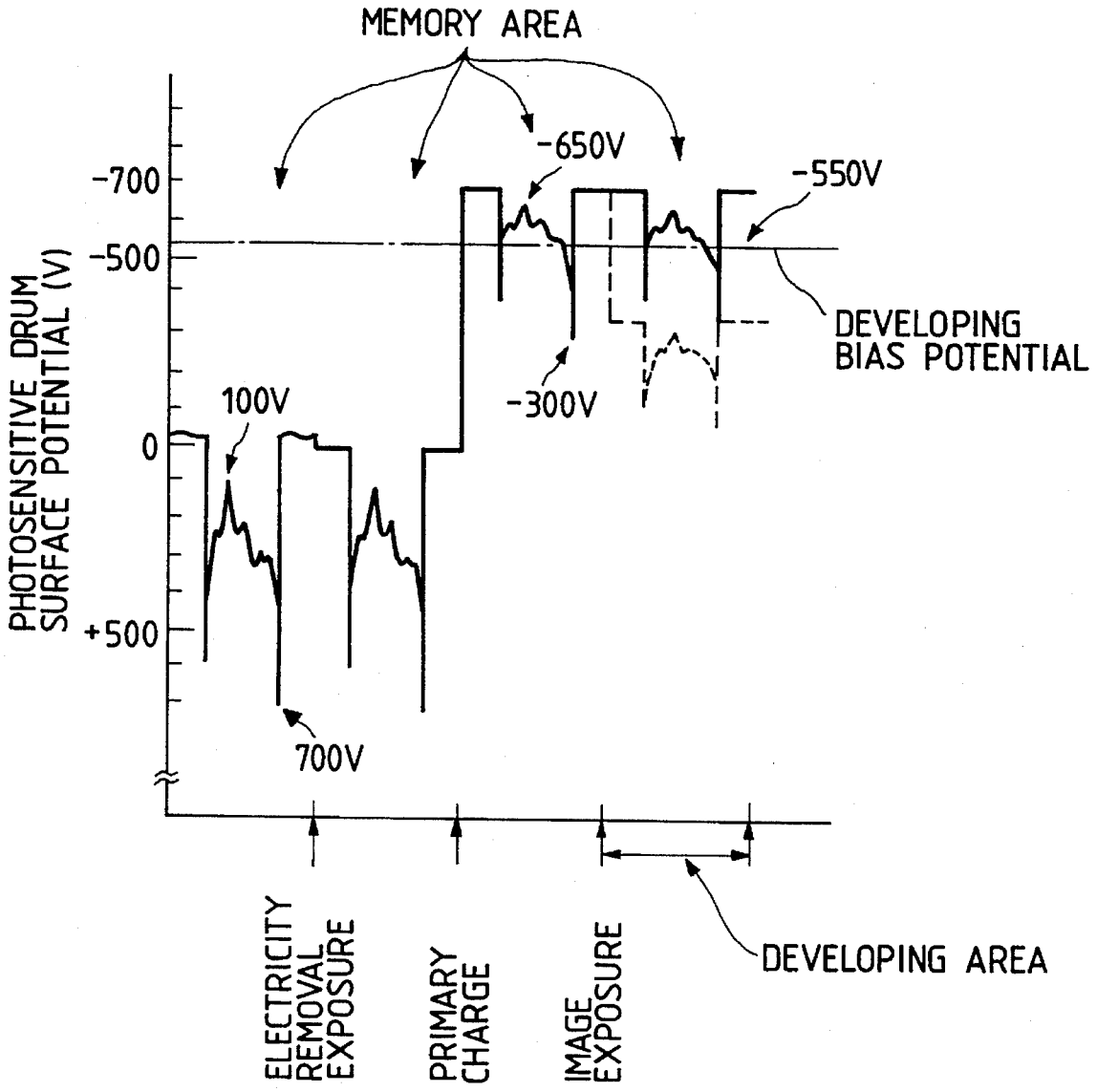
FIG. 2 is a graph showing a change in surface potential of a photosensitive drum having a memory area in a conventional image forming apparatus.

FIG. 2 is a graph showing a change in surface potential obtained when a primary charge process is performed onto an electrostatic latent image forming area on the photosensitive drum having a memory area after full-surface exposure like in the prior art. As is apparent from FIG. 2, the potential (about +100 to +700 V) of the memory area on the photosensitive drum 1 remains after the photosensitive drum 1 is subjected to electricity removal by electricity removal exposure. Even when the surface potential of the photosensitive drum 1 is charged at −700 V by the primary charge process, the potential of the memory area is −300 V to −650 V. For this reason, a developing electric field corresponding to a potential difference (indicated by a dotted curve in FIG. 2) between the potential (−300 to −650 V) of the memory area and a developing bias voltage (−550 V) is formed. In other words, an electrostatic latent image is formed by the memory even on a non-image area on which no electrostatic latent image is formed, and is developed to form an unnecessary toner image. As a result, the unnecessary toner image is transferred onto the transfer material P, thus causing image nonuniformity.

Alternatively, since the memory area is formed on an image area on which an electrostatic latent image is to be formed, even when an electrostatic latent image is formed on the image area, the electrostatic latent image has a potential lower than that of an electrostatic latent image formed on a normal image area free from the memory, and the electrostatic latent image in the memory area is developed to have a higher density, resulting in image nonuniformity.

More specifically, the memory area on the photosensitive drum 1 is charged at a potential having a polarity opposite to that of an electrostatic latent image to be formed on the photosensitive drum 1, i.e., at a potential having a positive polarity. For this reason, the charged portion cannot be removed by electricity removal exposure using only an electricity removal lamp after the transfer process, and the next primary charge process is started in this state. Therefore, in order to charge the memory area at a desired potential, a normal area subjected to electricity removal is charged at a higher potential than a normal one, and consequently, the memory area has a potential lower than that of the normally charged area even after the primary charge process.

In particular, since a stripe-shaped memory area of a drum portion corresponding to the end portion of the transfer material P has a strong memory, a considerably large surface potential difference from the potential of the normal area after the primary charge process remains, and consequently appears as a large image density difference. This memory is conspicuous on the drum portion corresponding to the trailing end portion of the transfer material.

Figure 3:
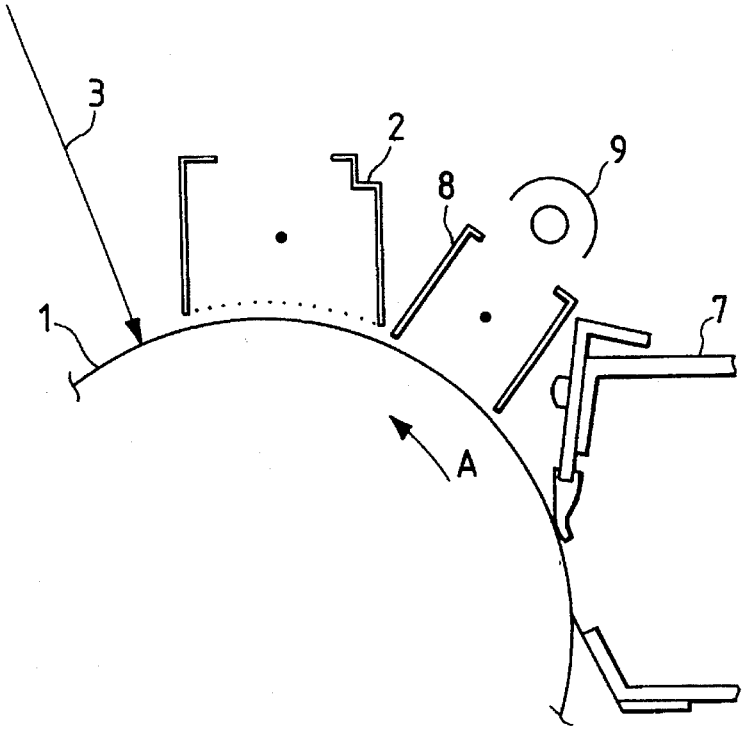
FIG. 3 is a schematic view showing a latent image forming unit of the image forming apparatus of the first embodiment.

In order to solve the above-mentioned problems, according to the present invention, the photosensitive drum 1 is simultaneously subjected to charge and full-surface exposure processes. For this purpose, in this embodiment, as shown in FIG. 3 which shows the schematic arrangement of a latent image forming unit of the copying apparatus shown in FIG. 1, an auxiliary charger 8 and an electricity removal lamp 9 are arranged at an identical position on the surface of the photosensitive drum 1 to vertically overlap each other, thereby sufficiently eliminating the above-mentioned image defect caused by the memory.

The effect of this embodiment will be described in detail below with reference to FIG. 4 which shows a change in surface potential obtained when the present invention is applied to the photosensitive drum 1 having the memory area.

Figure 8:
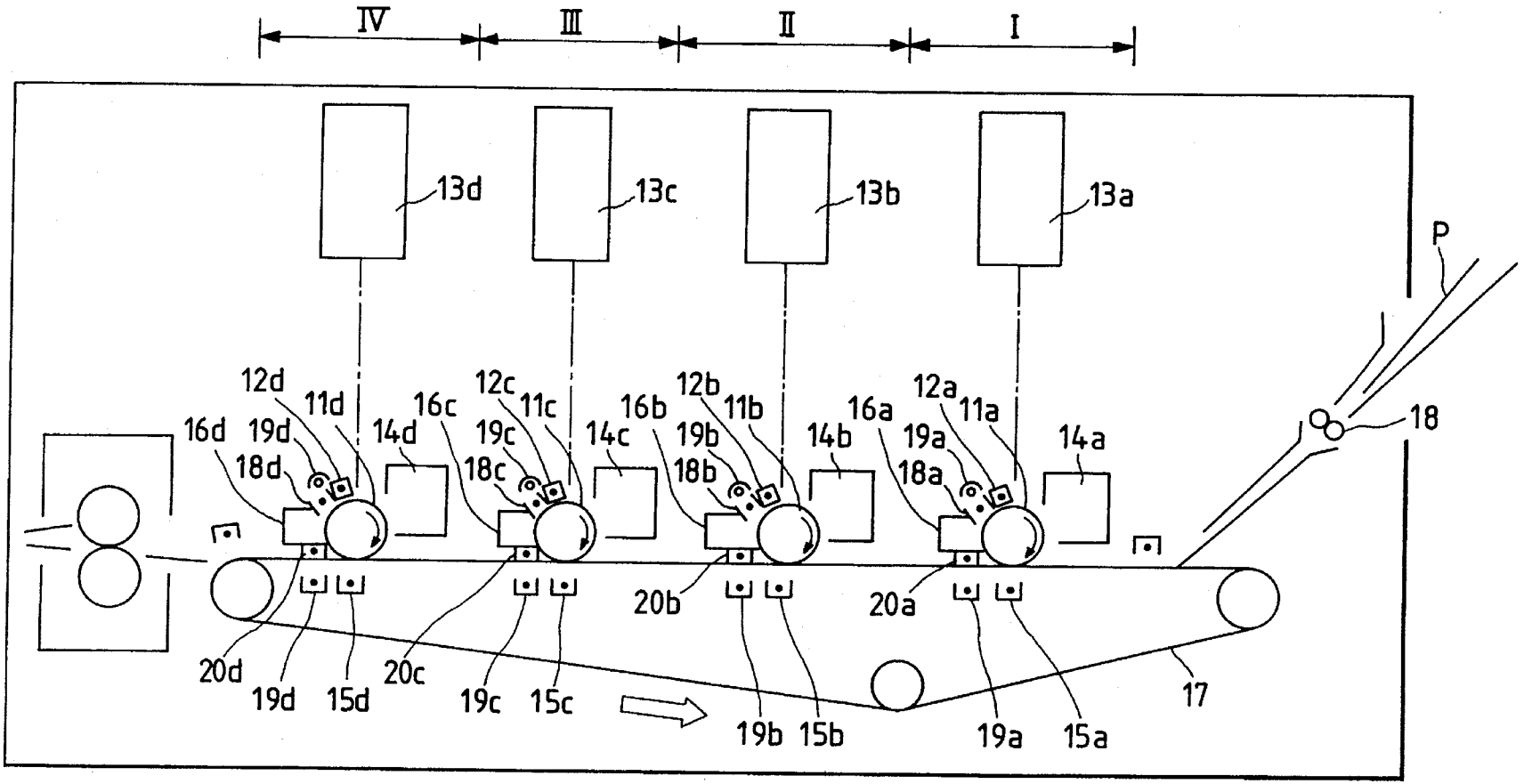
FIG. 8 is a schematic view showing the second embodiment of an image forming apparatus according to the present invention.

In this embodiment, after the residual toner on the surface of the photosensitive drum 1 is removed by the cleaner 7, the photosensitive drum 1 is charged by the auxiliary charger 8 at a potential having the same polarity (i.e., negative polarity) as that of an electrostatic latent image to be formed on the photosensitive drum 1 (first charge process), and at the same time, the photosensitive drum 1 is uniformly subjected to full-surface exposure by the electricity removal lamp 9. In this case, if the drum 1 is charged by only the auxiliary charger 8 without performing exposure by the electricity removal lamp 9, the memory area and the normal area excluding the memory area on the photosensitive drum 1 are respectively charged at about 0 V to −700 V and at about −800 V to −850 V, as shown in FIG. 8. Note that the full-surface exposure by the electricity removal lamp 9 means that the entire width which can be subjected to image formation at least in the direction of generator of the photosensitive body is uniformly exposed.

In contrast to this, when the electricity removal lamp 9 and the auxiliary charger 8 are simultaneously activated to perform charge and sufficient exposure processes at the same time, as described above, electric charges charged by the auxiliary charger 8 are immediately electrically conducted and attenuated by the photoconductive layer due to the photoconductivity of the photosensitive drum 1, and as a result, the normal area on the photosensitive drum 1 is electricity-removed to almost 0 V without being charged at a considerably high potential by the auxiliary charger 8. On the other hand, the memory area on the photosensitive drum 1 is electricity-removed to almost 0 V since charges having an opposite polarity (positive polarity) are removed to eliminate the memory. Thereafter, the photosensitive drum 1 is charged by the primary charger 2 (second charge process), i.e., is charged at a surface potential of −700 V by the primary charge process.

The developing bias voltage for forming a developing electric field is set to be −550 V. The difference (150 V) between the charged potential (−700 V) on the photosensitive drum 1 and the developing bias voltage (−550 V) corresponds to a fog-removal voltage. The toner in each developer is always attracted by the developing sleeve of the developer by the electric field formed by this potential difference without becoming attached to the photosensitive drum 1, and hence, no fogging occurs on a blank portion of an image.

Figure 4:
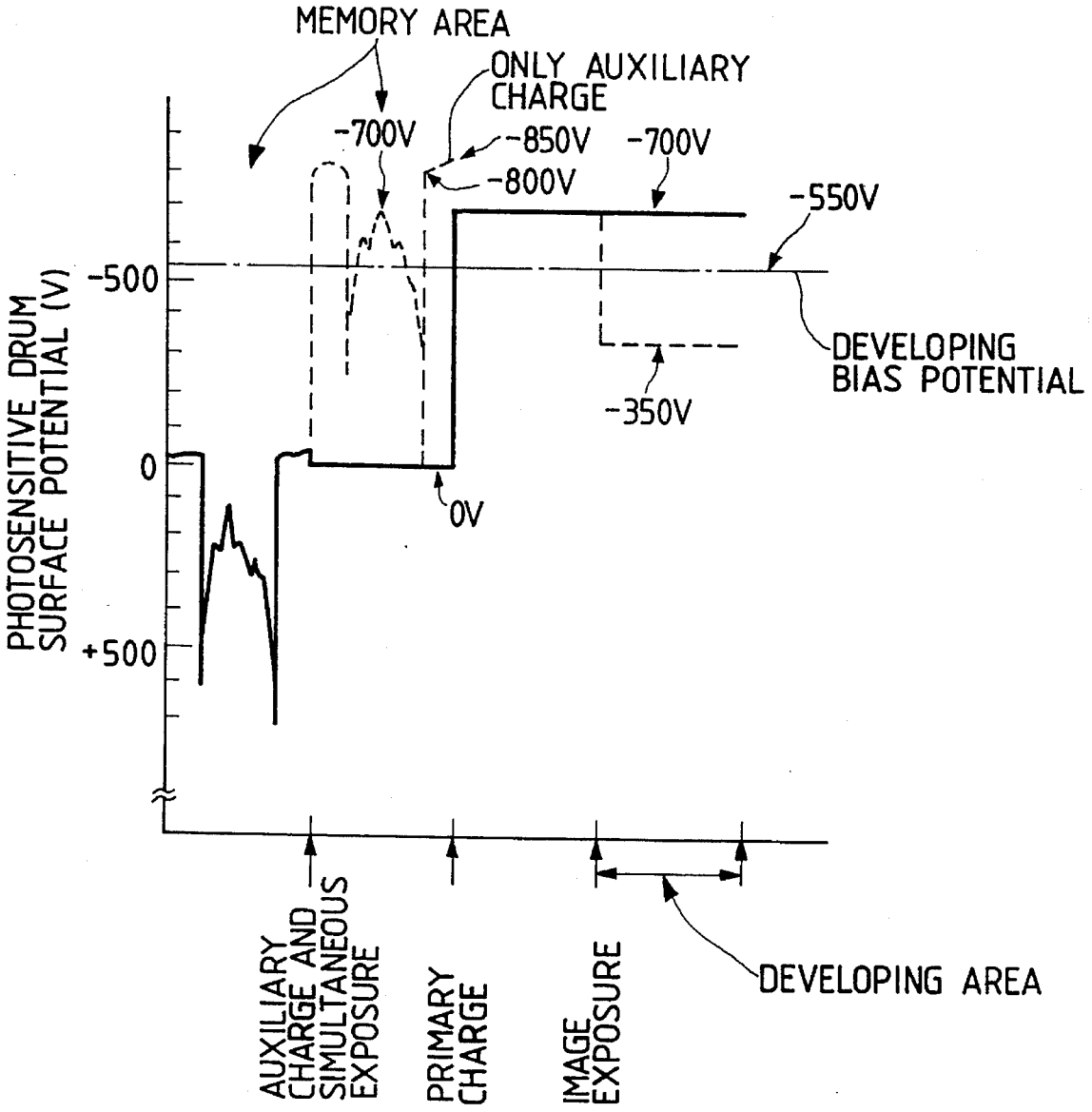
FIG. 4 is a graph showing a change in surface potential of a photosensitive drum having a memory area in the image forming apparatus of the first embodiment.

On the other hand, since a portion, corresponding to an image pattern, on the photosensitive drum 1 is irradiated with a laser beam at an intensity corresponding to the image density, the potential of the portion exposed with the laser beam is sufficiently lowered to a potential (−350 V) lower than the developing bias voltage (−550 V), as shown in FIG. 4. The toner on the developing sleeve becomes attached to the photosensitive drum 1 by a developing electric field formed by the developing bias voltage and the surface potential of the exposed portion on the photosensitive drum 1, thus forming a toner image on the photosensitive drum 1.

As described above, according to this embodiment, prior to the primary charge process of the photosensitive drum 1, since the photosensitive drum 1 is charged by the auxiliary charger 8 (first charge process) and is simultaneously subjected to electricity removal exposure by the electricity removal lamp 9, so that the memory area on the photosensitive drum 1 has the same polarity (i.e., negative polarity) as that of an electrostatic latent image to be formed on the photosensitive drum 1, the memory area on the photosensitive drum 1 is removed before the primary charge process, and the normal area free from the memory can be electricity-removed at an almost uniform potential without being charged at a considerably high potential. Therefore, the primary charge process as the second charge process, the image exposure process, and the developing process can be normally performed, and an image defect caused by a toner image formed on the memory area and transferred onto the transfer material P can be prevented unlike in the prior art.

However, the auxiliary charge process in the first charge process often poses various problems as compared to a conventional case wherein only the primary charge process (second charge process) is performed. More specifically, problems associated with exposure and degradation of the photosensitive drum due to discharge products such as $O_3$, $NO_x$, and the like produced upon execution of the auxiliary charge process, pollution of the environment by the discharge products, an increase in power consumption, and the like become more serious. In particular, since a large amount of current flows through the photosensitive drum due to the full-surface exposure process performed simultaneously with the auxiliary charge process, the residual potential increases as the photosensitive drum is used more, and a change in light attenuation characteristics is considerably accelerated. As a result, deterioration of image quality caused by these problems becomes conspicuous.

For this reason, in this embodiment, upon removal of the memory by the auxiliary charge process, the charge condition of the auxiliary charge process is controlled on the basis of the transfer condition of the transfer means. Thus, production of discharge products such as $O_3$, $NO_x$, and the like can be suppressed, and exposure and degradation of an image carrier caused by the discharge products, pollution of the environment due to the discharge products, and the like can be eliminated.

This embodiment will be described in detail below.

Figure 5:
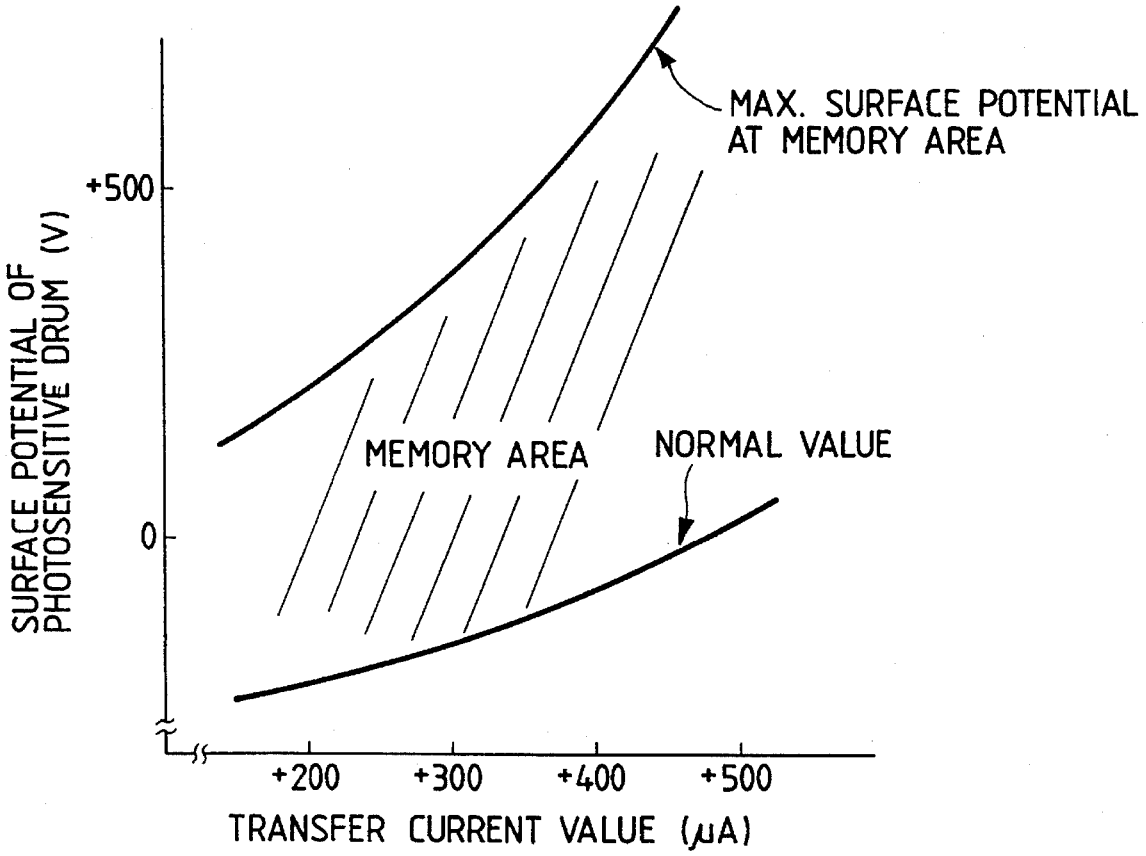
FIG. 5 is a graph showing the relationship between the transfer current value and the surface potential on the memory area of the photosensitive drum.

As a result of experiments and studies of the present inventors, it was found that a potential drift caused by the memory generated on the photosensitive drum 1 after the transfer process considerably changed depending on the transfer charge condition, e.g., the transfer current value upon transferring of a toner image by the transfer charger 5*b*. For example, FIG. 5 shows the relationship between the transfer current value to be applied to the transfer charger and the surface potential on the memory area of the photosensitive drum 1. As can be understood from FIG. 5, the potential drift caused by the memory generated on the photosensitive drum 1 has different magnitudes depending on the transfer current value. More specifically, as can be seen from FIG. 5, the surface potential on the memory area of the photosensitive drum 1 is increased (strengthened) depending on the transfer current value.

On the other hand, an optimal condition of the transfer charger 5*b* changes depending on the ambient environmental condition, the type of the transfer material P, the state of an electrostatic latent image on the photosensitive drum 1, the states of toners in the developers 4Y to 4B, or the state of the photosensitive body of the photosensitive drum 1. Therefore, in order to obtain a high-quality image, the transfer condition is changed in correspondence with the above-mentioned image forming condition. In particular, in an image forming apparatus which can form a full-color image, respective color toners have different optimal transfer charge conditions. For example, when a standard paper sheet is used as the transfer material P in an environment at ordinary temperature and ordinary humidity, the transfer current value is changed to +200 μA for the first color, +250 μA for the second color, +300 μA for the third color, and +350 μA for the fourth color. In an low-humidity environment, for example, the transfer current value is changed to +300 μA for the first color, +350 μA for the second color, +400 μA for the third color, and +500 μA for the fourth color.

Figure 6:
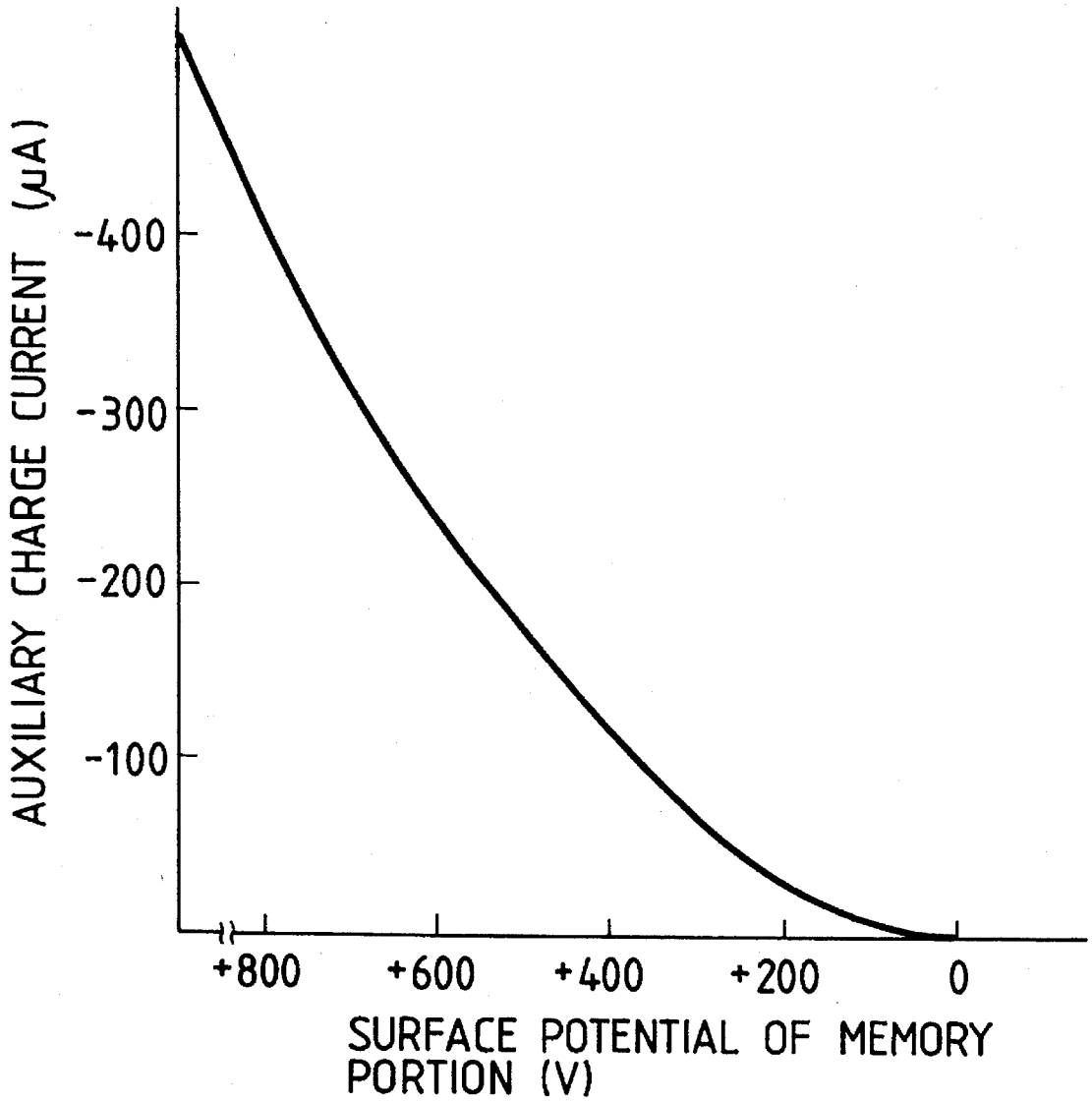
FIG. 6 is a graph showing the relationship between the charge current of an auxiliary charger required for performing electricity removal of the memory area, and the surface potential on the memory area.

FIG. 6 shows the charge current (a current to be applied to the charger 8) of the auxiliary charger 8 required for performing electricity removal of the memory area as a function of the surface potential on the memory area. As can be understood from FIG. 6, as the memory area becomes stronger, i.e., the surface potential of the memory area has positive polarity as a polarity opposite to a normal charge polarity and is higher, the charge current of the auxiliary charger 8 required for performing electricity removal of the memory area increases.

When the charge condition of the auxiliary charger 8 is fixed without being controlled, in order to remove charges on a maximum memory area generated when, for example, a transfer condition of +500 μA for the transfer current value of the fourth color in a low-humidity environment, the charge current value (auxiliary charge current value) of the auxiliary charger 8 must always be set to be −400 μA. When such a current value is set, the auxiliary charge current becomes excessive for an area other than the maximum memory area, most of auxiliary charge current components pass through the photoconductive layer of the photosensitive drum 1 without contributing to electricity removal of the memory area, and these excessive current components promote conduction degradation of the photosensitive drum 1.

Figure 7:
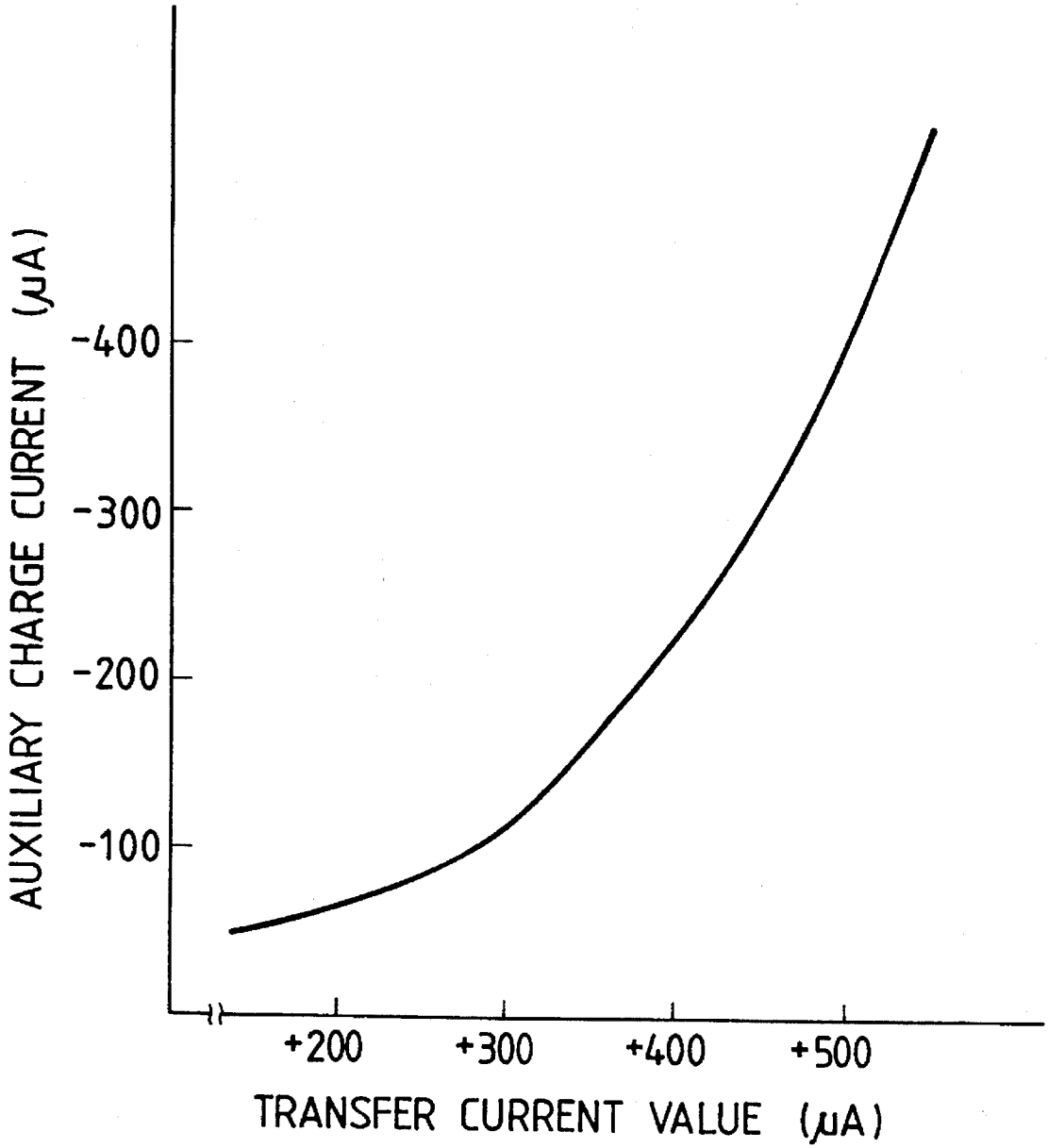
FIG. 7 is a graph showing the control value of the auxiliary charge current as a function of the transfer current value in the first embodiment.

In order to suppress the above-mentioned conduction degradation of the photosensitive drum 1 caused by the excessive current, in this embodiment, the charge current of the auxiliary charger 8 is controlled on the basis of the transfer current of the transfer charger 5*b*. FIG. 7 shows the control value of the auxiliary charge current as a function of the transfer current value in this embodiment.

In this embodiment, as shown in FIG. 7, since the charge current of the auxiliary charger 8 is controlled to have a value required and sufficient for electricity removal of the memory area on the basis of the transfer current, the above-mentioned conduction degradation of the photosensitive drum 1 caused by the excessive current can be greatly eliminated. More specifically, since most of charge current components of the auxiliary charger 8 remove positive electric charges trapped near the surface portion of the photosensitive drum 1, the conduction degradation of the photosensitive drum 1 due to the charge current does not easily occur.

Since the charge current of the auxiliary charger 8 is controlled to have a value required and sufficient for electricity removal of the memory, production of discharge products such as $O_3$, $NO_x$, and the like can be eliminated to about ⅓ to ¼ as compared to a case wherein the charge condition is fixed at a charge current value for electricity removal of the maximum memory area.

As described above, according to this embodiment, an image defect caused by a toner image formed on a memory area can be avoided. In addition, since the charge current of the auxiliary charger 8 is controlled on the basis of the transfer current of the transfer charger 5*b*, the degradation of the photosensitive drum 1 caused by full-surface exposure performed simultaneously with the auxiliary charge process, and deterioration of image quality caused by the degradation can be remarkably suppressed. At the same time, production of discharge products such as $O_3$, $NO_x$, and the like can be eliminated. More specifically, when the charge current of the auxiliary charger 8 is not controlled, the service life of the photosensitive drum expires after the image forming process is repeated an average of about 8,000 times. Contrary to this, according to this embodiment, the service life of the photosensitive drum can be prolonged to about 12,000 times.

Second Embodiment

FIG. 8 is a schematic view showing the second embodiment of an electrophotographing apparatus according to the present invention. The electrophotographing apparatus of this embodiment exemplifies a case wherein the present invention is applied to a multi-color electrophotography copying machine having four image forming units I to IV.

In this multi-color electrophotography copying machine, the image forming units I to IV respectively comprise photosensitive drums 11*a* to 11*d*, and primary chargers 12*a* to 12*d*, exposure means 13*a* to 13*d*, developers 14*a* to 14*d*, transfer chargers 15*a* to 15*d*, and cleaners 16*a* to 16*d* are respectively arranged around the corresponding photosensitive drums. Furthermore, an endless transfer material carrier belt (convey means) 17 is arranged below the photosensitive drums 11*a* to 11*d* to extend through the image forming units I to IV, and conveys a transfer material P fed by paper feed rollers 18 to contact the photosensitive drums 11*a* to 11*d* of the image forming units I to IV at the positions of the transfer chargers 15*a* to 15*d*. Moreover, auxiliary chargers 18*a* to 18*d* and electricity removal lamps 19*a* to 19*d* which are used for simultaneously performing the charge and full-surface exposure processes of the photosensitive drums 11*a* to 11*d* are arranged at identical positions on the surface of the photosensitive drums 11*a* to 11*d* to vertically overlap each other.

Since the image forming process by the copying machine of this embodiment is basically the same as that in the first embodiment, a detailed description thereof will be omitted. In this embodiment as well, after the residual toners on the surfaces of the photosensitive drums 11*a* to 11*d* are removed by the cleaners 16*a* to 16*d*, the photosensitive drums 11*a* to 11*d* are charged by the auxiliary chargers 18*a* to 18*d* to have the same polarity (i.e., negative polarity) as that of electrostatic latent images formed thereon. At the same time, the photosensitive drums 11*a* to 11*d* are subjected to uniform full-surface exposure by the electricity removal lamps 19*a* to 19*d*, so that both memory areas and normal areas free from the memory areas are subjected to electricity removal to have a surface potential of about 0 V. Thereafter, upon operation of the primary chargers 12*a* to 12*d* and laser beam exposure devices of the exposure means 13*a* to 13*d*, color-separated electrostatic latent images corresponding to image exposure patterns are respectively formed on the photosensitive drums 11*a* to 11*d*, and are respectively developed by yellow, magenta, cyan, and black toners upon operation of the developers 14*a* to 14*d* to be visualized as toner images. Thereafter, these toner images are sequentially transferred onto the transfer material carried on the carrier belt 17 upon operation of the transfer chargers 15*a* to 15*d*, thereby forming a full-color image on the transfer material P.

In this embodiment as well, as described above, the photosensitive drums 11*a* to 11*d* are charged by the auxiliary chargers 18*a* to 18*d* (first charge process) and are simultaneously subjected to electricity removal exposure by the electricity removal lamps 19*a* to 19*d* so that the memory areas on the photosensitive drums 11*a* to 11*d* have the same polarity (i.e., negative polarity) as that of electrostatic latent images formed on the photosensitive drums 11*a* to 11*d*, the memory areas on the photosensitive drums 11*a* to 11*d* are removed before the primary charge process, and the normal areas free from the memory areas can be electricity-removed at an almost uniform potential without being charged at a considerably high potential. Thereafter, the primary charge, image exposure, and developing processes can be normally performed, and no image defect caused by a toner image formed on the memory area and transferred to the transfer material P is observed.

Furthermore, since the charge currents of the auxiliary chargers 18*a* to 18*d* are controlled on the basis of the current values of the transfer chargers 15*a* to 15*d*, degradation of the photosensitive drums 11*a* to 11*d* caused by full-surface exposure to be performed simultaneously with the auxiliary charge process, and deterioration of image quality caused by the degradation can be remarkably suppressed. At the same time, production of discharge products such as $O_3$, $NO_x$, and the like can be eliminated. More specifically, when the charge currents of the auxiliary chargers 18*a* to 18*d* are not controlled, the service life of the photosensitive drum of each color expires after the image forming process is repeated an average of about 24,000 times. Contrary to this, according to this embodiment, the service life of each photosensitive drum can be greatly prolonged to about 36,000 times.

Third Embodiment

Figure 9:
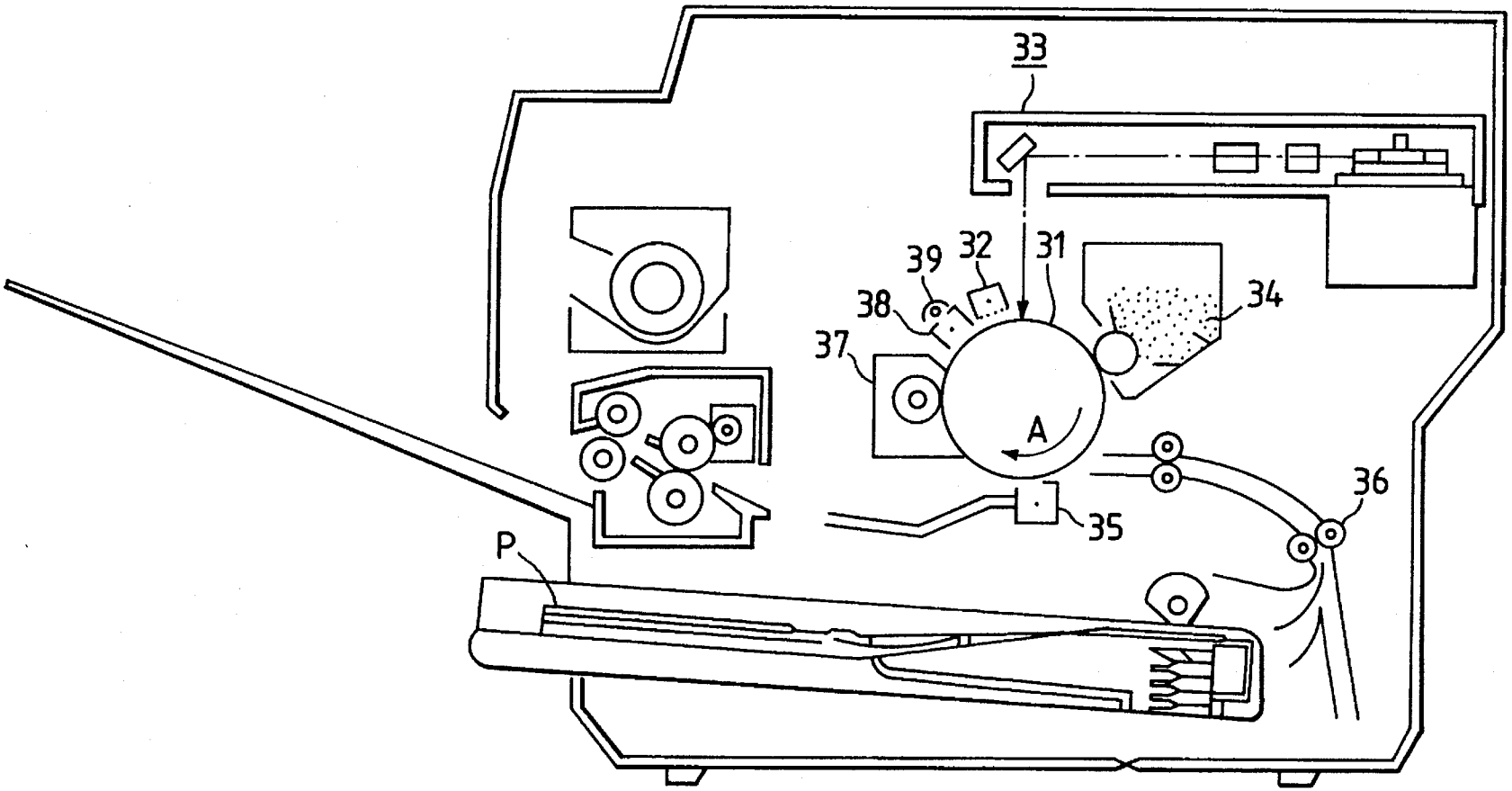
FIG. 9 is a schematic view showing the third embodiment of an image forming apparatus according to the present invention.

FIG. 9 is a schematic view showing the third embodiment of an electrophotographing apparatus according to the present invention. In the electrophotographing apparatus of this embodiment, the present invention is applied to an image forming apparatus which has no transfer device such as a transfer drum or a transfer belt, e.g., a monochrome electrophotography digital laser beam printer. This printer comprises a photosensitive drum 31, and a primary charger 32, a laser beam scanner 33 of an exposure means, a developer 34, a transfer charger 35, and a cleaner 37 are arranged around the photosensitive drum 31. Furthermore, an auxiliary charger 38 and an electricity removal lamp 39, which are used for simultaneously performing charge and full-surface exposure processes of the photosensitive drum 31 are arranged at an identical position on the surface of the photosensitive drum 31 to vertical overlap each other.

Since the image forming process by the printer of this embodiment is basically the same as that in the first embodiment, a detailed description thereof will be omitted as in the second embodiment. In this embodiment as well, after the residual toner on the surface of the photosensitive drum 31 is removed by the cleaner 37, the photosensitive drum 31 is charged by the auxiliary charger 38 to have the same polarity (i.e., negative polarity) as that of an electrostatic latent image formed thereon, and at the same time, is uniformly exposed by the electricity removal lamp 39, so that both the memory area and the normal area are subjected to electricity removal to have a surface potential of about 0 V. Thereafter, upon operation of the primary charger 32, the laser beam scanner 33, and the developer 34, a toner image formed by reversal development on the photosensitive drum 31 is transferred onto a transfer material P fed by, e.g., paper feed rollers 36 and the like at a transfer portion where the transfer material P contacts the photosensitive drum 31 upon operation of the transfer charger 35.

In this embodiment as well, since the photosensitive drum 31 can be uniformly primary-charged, a high-quality image free from an image defect corresponding to a memory area unlike in the prior art can be obtained. Furthermore, since the charge current of the auxiliary charger 38 is controlled on the basis of the current value of the transfer charger 35, degradation of the photosensitive drum 31 caused by full-surface exposure to be performed simultaneously with the auxiliary charge process, and deterioration of image quality caused by the degradation can be remarkably suppressed. At the same time, production of discharge products such as $O_3$, $NO_x$, and the like can be eliminated.

Figure 10:
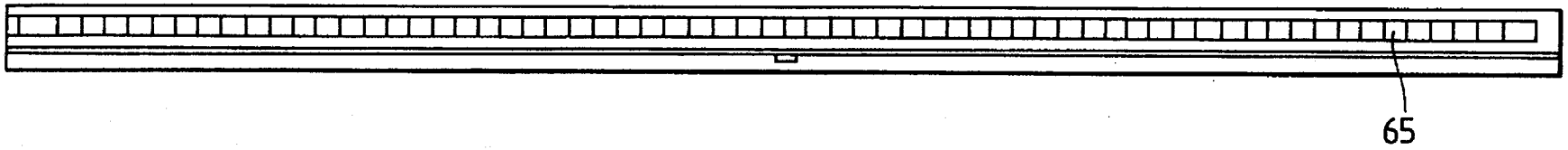
FIG. 10 is a sectional view showing an LED lamp array as an electricity removal lamp used in the present invention.
Figure 11:
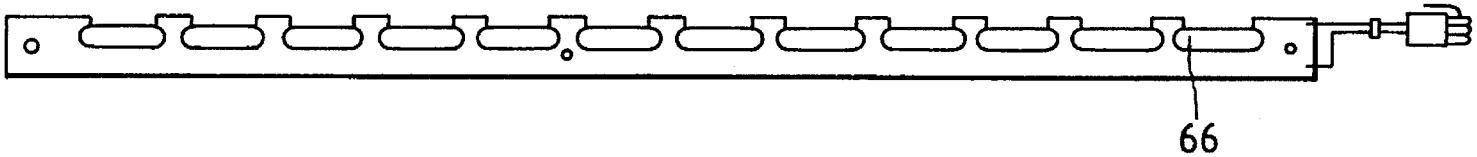
FIG. 11 is a sectional view showing a fuse lamp array as an electricity removal lamp which can be used in the present invention.

In each of the first to third embodiments described above, the electricity removal lamp 9 or the like for performing electricity removal of the photosensitive drum by full-surface exposure comprises an LED lamp array 65, as shown in FIG. 10. However, the present invention is not limited to this. For example, an exposure means such as a fuse lamp array 66 shown in FIG. 11 may be used. For example, when the electricity removal lamp 9 adopts the LED lamp array 65, the LED lamp array 65 is constituted by linearly arranging 64 lamps each having a peak wavelength of 695 nm, and can be arranged above the auxiliary charger, so that the arrangement direction of the lamps extends parallel to the axial direction of the photosensitive drum 1.

Figure 12:
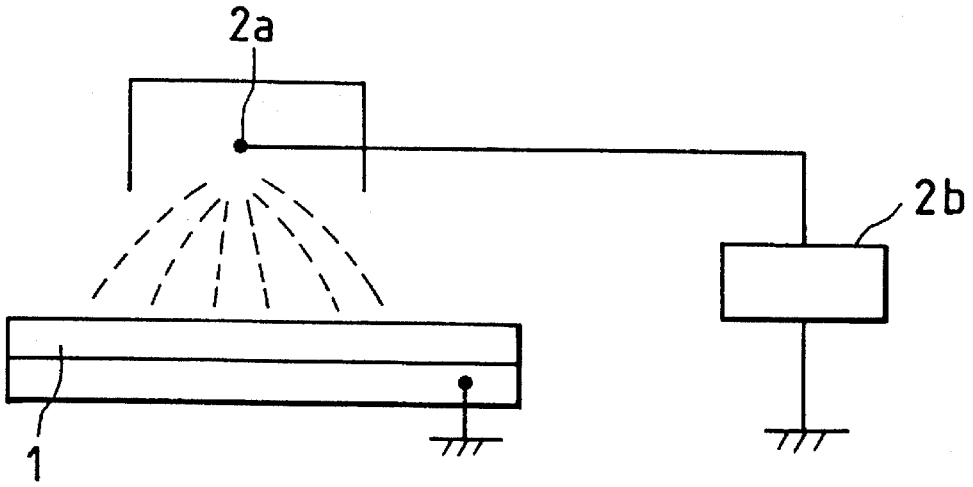
FIG. 12 is a sectional view showing a corotron type charger used as an auxiliary charger in the present invention.

Also, the auxiliary charger 8 or the like comprises a corotron type charger, as shown in FIG. 12. Alternatively, a scorotron type charger shown in FIG. 13 may be used to control the charge amount on the photosensitive drum.

Furthermore, in each of the first to third embodiments, the surface potential of the photosensitive drum after the primary charge process, the surface potential after laser beam exposure, the developing bias voltage, and the like are not limited to values exemplified in the corresponding paragraphs, and may assume various values in correspondence with a change in environment. Of course, exposure is not limited to laser beam exposure. The present invention can be equally applied to various other image forming apparatuses such as electrophotography type copying machines, printers, and the like in addition to the multi-color electrophotography copying apparatus.

As described above, according to the image forming apparatus of each of the first to third embodiments, in order to eliminate a memory generated on a photosensitive body due to peeling discharge caused by accumulation of electric charges on the surface of a transfer material, in particular, accumulation of electric charges on the end portion of the transfer material, an auxiliary charge process as the first charge process and a full-surface exposure process are simultaneously performed on the photosensitive body, and a primary charge process as the second charge process having the same polarity as that of the first charge process is performed on the photosensitive body to uniformly charge the surface of the photosensitive body at a desired potential. Thereafter, the surface of the photosensitive body is exposed in correspondence with an image pattern to form an electrostatic latent image, and the latent image is developed by a developing agent to be visualized as a toner image. For this reason, the memory area on the photosensitive body can be prevented from being developed and transferred onto the transfer material unlike in the prior art. Therefore, a high-quality image free from an image defect or image nonuniformity caused by the memory area can be obtained without causing adverse influences such as a cleaning error, dielectric breakdown of the photosensitive body, and the like.

Since the first charge condition is controlled on the basis of the transfer condition of a transfer means, production of discharge products such as $O_3$, $NO_x$, and the like can be suppressed, and exposure and degradation of the photosensitive body caused by the discharge products, pollution of the environment due to the discharge products, and the like can be eliminated.

Fourth Embodiment

This embodiment is characterized in that, in the image forming apparatus of the first embodiment shown in FIG. 1, the charge condition of the auxiliary charge process upon removal of the memory on the photosensitive drum 1 by the auxiliary charge process (first charge process) is controlled on the basis of the condition of a transfer material. With this control, production of discharge products such as $O_3$, $NO_x$, and the like can be suppressed, and exposure and degradation of the photosensitive body caused by the discharge products, pollution of the environment due to the discharge products, and the like can be eliminated.

This embodiment will be described in detail below.

The studies by the present inventors revealed that the above-mentioned memory had different strengths depending on the properties such as the type of the transfer material P shown in FIG. 1. More specifically, the strength of the memory depends on the properties such as the material, thickness, flatness, and the like of a transfer material. For example, when a resin film for a projector, a coated sheet which has been subjected to calender treatment, to improve flatness, or the like is used as the transfer material P, the memory is relatively strengthened as compared to a case wherein a normal sheet is used as the transfer material P, and the memory tends to be relatively strengthened as the thickness of the transfer material P increases.

Figure 18:
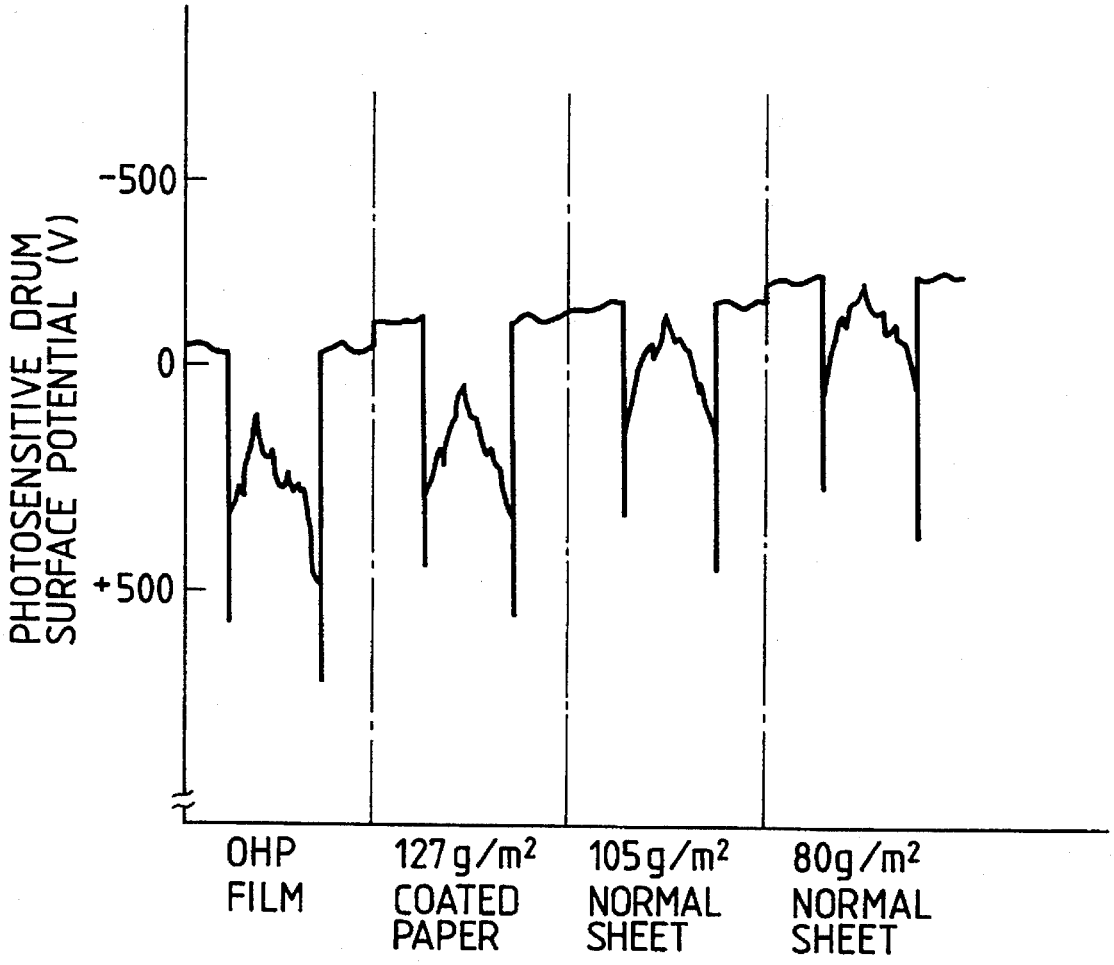
FIG. 18 is a graph showing the relationship between the type of transfer materials and the surface potential of a photosensitive drum having a memory area.

FIG. 18 shows the surface potential of the memory area on the photosensitive drum 1 after the transfer process in correspondence with a normal sheet of 80 g/m$^2$, a normal sheet of 105 g/m$^2$, a coated sheet, and a resin film for a projector (to be referred to as an "OHP" film hereinafter) used as the transfer material P. As can be understood from FIG. 18, the strength of the memory varies depending on the properties (type) such as the material, thickness, flatness, and the like of the transfer material P.

As shown in FIG. 6 above, as the memory area on the photosensitive drum becomes stronger, i.e., as the surface potential of the memory area has a polarity opposite to a normal charge polarity and is higher, the charge current of the auxiliary charger 8 required for attaining electricity removal of the memory area increases.

When the charge condition of the auxiliary charger 8 is fixed without being controlled, in order to remove charges on a maximum memory area generated when, for example, an OHP sheet is used, the charge current value (auxiliary charge current value) of the auxiliary charger 8 must always be set to be −400 μA. When such a current value is set, if a normal sheet of 80 g/m$^2$ which is most frequently used is used, most of auxiliary charge current components become excessive and pass through the photoconductive layer of the photosensitive drum 1 without contributing to electricity removal of the memory area, and these excessive current components promote conduction degradation of the photosensitive drum 1.

Figure 19:
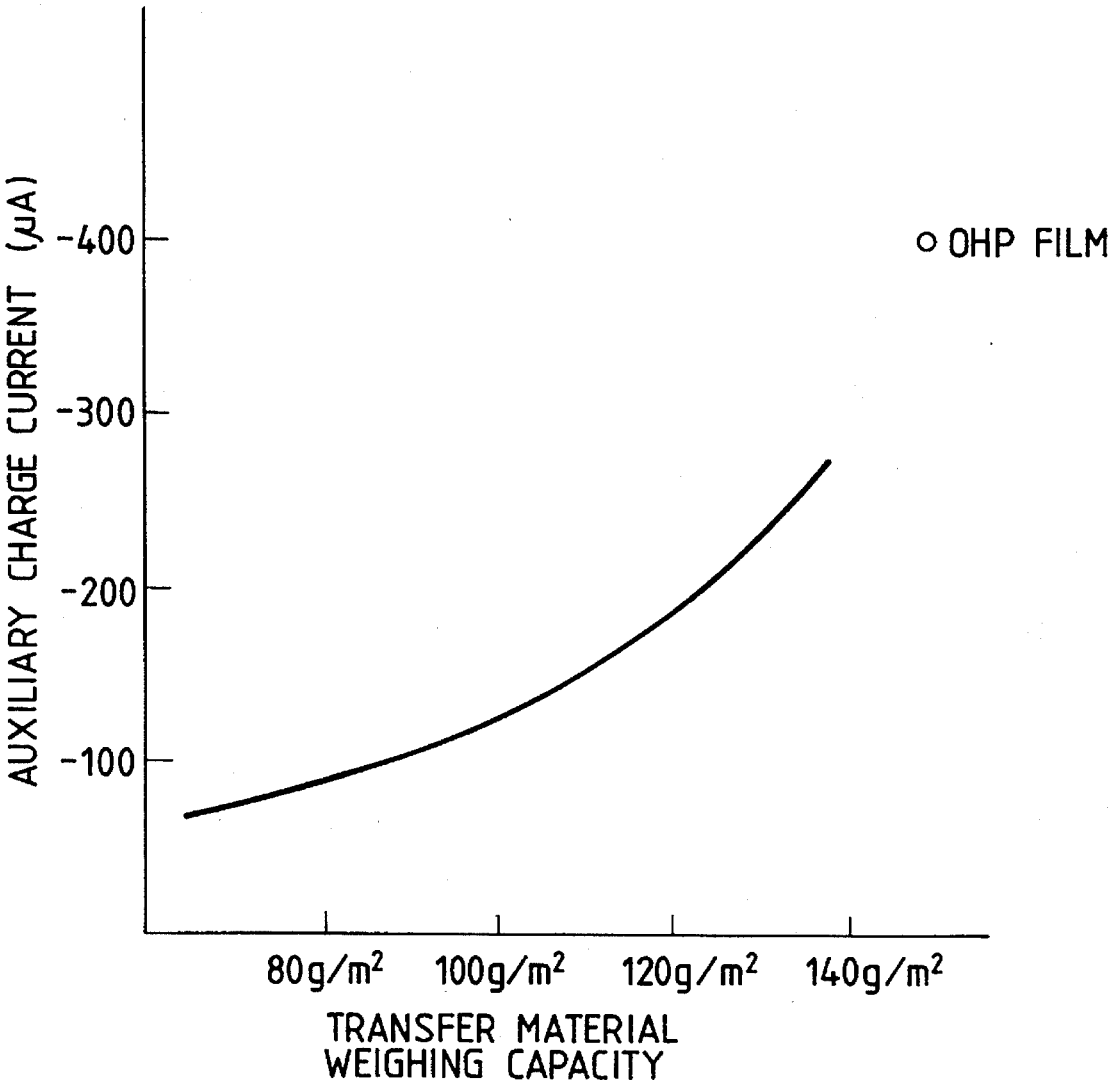
FIG. 19 is a graph showing the control value of the auxiliary charge current as a function of the type of transfer materials in the fourth embodiment of an image forming apparatus according to the present invention.

In this embodiment, in order to suppress the above-mentioned conduction degradation of the photosensitive drum 1 caused by the excessive current, the charge current of the auxiliary charger 8 is controlled on the basis of the type such as the thickness, material, and the like of the transfer material. For this purpose, in this embodiment, an OHP film sensor and a transfer material thickness sensor (neither are shown) are arranged at a paper feed unit of the image forming apparatus shown in FIG. 1, and the properties of the transfer material P are discriminated on the basis of the output values from these sensors, thereby controlling the charge current of the auxiliary charger 8. FIG. 19 shows the control value of the auxiliary charge current corresponding to the thickness of the transfer material and an OHP film. In the graph of FIG. 19, an OHP film is represented by an open circle, is independent of the abscissa of the graph, and represents only the auxiliary charge current.

In this embodiment, as shown in FIG. 19, since the charge current of the auxiliary charger 8 is controlled to have a value required and sufficient for achieving electricity removal of the memory on the basis of the type such as the thickness, material, and the like of the transfer material, the above-mentioned conduction degradation of the photosensitive drum 1 can be greatly eliminated. More specifically, since most of charge current components of the auxiliary charger 8 remove positive electric charges trapped near the surface portion of the photosensitive drum 1, the conduction degradation of the photosensitive drum 1 due to the charge current does not easily occur.

Since the charge current of the auxiliary charger 8 is controlled to have a value required and sufficient for electricity removal of the memory, production of discharge products such as $O_3$, $NO_x$, and the like can be eliminated to about ⅓ to ¼ as compared to a case wherein the charge condition is fixed at a charge current value for electricity removal of the maximum memory area.

As described above, according to this embodiment, since the primary charge process is performed after the auxiliary charge process and full-surface exposure process of the photosensitive drum 1 are simultaneously performed, the photosensitive drum 1 can be uniformly primary-charged, thus preventing an image defect caused by a toner image formed on the memory area unlike the prior art. In addition, since the charge current of the auxiliary charger 8 is controlled on the basis of the type such as the thickness, material, and the like of the transfer material, the degradation of the photosensitive drum 1 caused by full-surface exposure performed simultaneously with the auxiliary charge process, and deterioration of image quality caused by the degradation can be remarkably suppressed. At the same time, production of discharge products such as $O_3$, $NO_x$, and the like can be eliminated. More specifically, when the charge current of the auxiliary charger 8 is not controlled, the service life of the photosensitive drum expires after the image forming process is repeated an average of about 8,000 times. Contrary to this, according to this embodiment, the service life of the photosensitive drum can be prolonged to about 12,000 times.

Fifth Embodiment

In this embodiment, the present invention is applied to the electrophotographing apparatus shown in FIG. 8 above. More specifically, as in the fourth embodiment, an OHP film sensor and a transfer material thickness sensor (neither are shown) are arranged at a paper feed unit of the transfer material, and the properties of a transfer material are discriminated on the basis of the output values from these sensors, thereby controlling charge currents upon removal of the memory areas on the photosensitive drums 11*a* to 11*d* by the auxiliary chargers 18*a* to 18*d* in correspondence with the properties of the transfer material.

With this control, in this embodiment as well, the photosensitive drums 11*a* to 11*d* can be uniformly primary-charged to eliminate an image defect caused by the memory areas. Also, degradation of the photosensitive drums 11*a* to 11*d* caused by full-surface exposure to be performed simultaneously with the auxiliary charge process, and deterioration of image quality caused by the degradation can be remarkably suppressed. At the same time, production of discharge products such as $O_3$, $NO_x$, and the like can be eliminated. More specifically, when the charge currents of the auxiliary chargers 18*a* to 18*d* are not controlled, the service life of the photosensitive drum of each color expires after the image forming process is repeated an average of about 24,000 times. Contrary to this, according to this embodiment, the service life of each photosensitive drum can be greatly prolonged to about 36,000 times.

Sixth Embodiment

In this embodiment, the present invention is applied to the electrophotographing apparatus shown in FIG. 9. In the electrophotographing apparatus shown in FIG. 9, the present invention is applied to an image forming apparatus which has no transfer device such as a transfer drum or a transfer belt, e.g., a monochrome electrophotography digital laser beam printer. In this embodiment, the same control as in the fourth and fifth embodiments is adopted.

In this embodiment as well, since the photosensitive drum 31 can be uniformly primary-charged, a high-quality image free from an image defect corresponding to a memory area unlike in the prior art can be obtained.

Since the charge current of the auxiliary charger 38 is controlled on the basis of the type such as the thickness, material, and the like of the transfer material, degradation of the photosensitive drum 31 caused by full-surface exposure to be performed simultaneously with the auxiliary charge process, and deterioration of image quality caused by the degradation can be remarkably suppressed. At the same time, production of discharge products such as $O_3$, $NO_x$, and the like can be eliminated.

As described above, according to each of the fourth to sixth embodiments, since the primary charge process is performed after the auxiliary charge process and the full-surface exposure process of a photosensitive body are simultaneously performed, the photosensitive body can be uniformly primary-charged, and an image defect caused by a toner image formed on a memory area can be prevented. Also, since the charge current of the primary charge process is controlled on the basis of the type such as the thickness, material, and the like of the transfer material, the degradation of the photosensitive body caused by the full-surface exposure performed simultaneously with the auxiliary charge process, and deterioration of image quality caused by the degradation can be remarkably suppressed. At the same time, production of discharge products such as $O_3$, $NO_x$, and the like can be suppressed, and exposure and degradation of the photosensitive body caused by the discharge products, pollution of the environment due to the discharge products, and the like can be eliminated.

Seventh Embodiment

In this embodiment, upon removal of the memory by the auxiliary charge process, the charge condition of the auxiliary charge process is controlled on the basis of the surface state of the photosensitive drum by the second charge process (primary charge process), thereby suppressing production of discharge products such as $O_3$, $NO_x$, and the like, and eliminating exposure and degradation of the photosensitive body caused by the discharge products, pollution of the environment due to the discharge products, and the like. In this embodiment, the present invention is applied to the electrophotography apparatus shown in FIG. 1 above.

This embodiment will be described in detail below.

Figure 20:
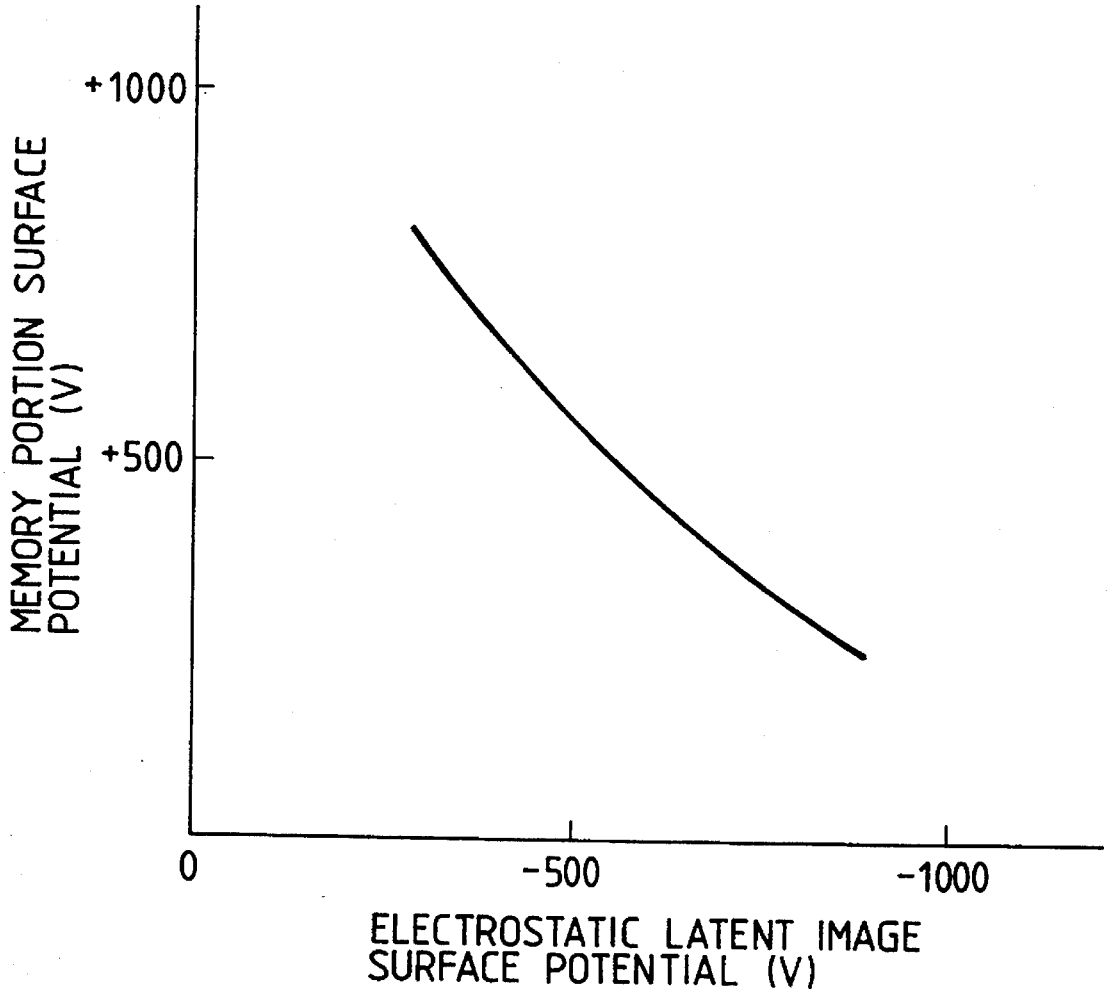
FIG. 20 is a graph showing the relationship between the surface potential of an electrostatic latent image and the surface potential on the memory area of the photosensitive drum.

According to the experiments and studies of the present inventors, it was found that a potential drift caused by the memory generated on the photosensitive drum 1 after the transfer process considerably changed depending on the surface potential of an electrostatic latent image formed by the primary charge process before the memory is generated. For example, FIG. 20 shows the relationship between the surface potential of an electrostatic latent image and the surface potential on the memory area of the photosensitive drum 1. As can be understood from FIG. 20, a potential drift caused the memory generated on the photosensitive drum 1 has different magnitudes depending on the surface potential of the electrostatic latent image. More specifically, as is apparent from FIG. 20, the surface potential on the memory area of the photosensitive drum 1 becomes higher (stronger) as the surface potential of the electrostatic latent image before generation of the memory is lower.

Charge control by the primary charger is mainly performed on the basis of the environmental condition, and the photosensitive drum is charged at −300 to −900 V by the primary charger. The memory varies depending on the surface potential (dark potential) at that time. As can be understood from FIG. 6 above, as the memory area on the photosensitive drum becomes stronger, i.e., as the surface potential of the memory area has a polarity opposite to a normal charge polarity and is higher, the charge current of the auxiliary charger 8 required for attaining electricity removal of the memory area increases.

However, when the charge condition of the auxiliary charger 8 is fixed without being controlled, in order to remove charges on a maximum memory area generated when, for example, the surface potential obtained by the primary charge process is as low as −300 V, the charge current value (auxiliary charge current value) of the auxiliary charger 8 must always be set to be −400 μA. When such a current value is set, if a condition with a surface potential of −900 V for the electrostatic latent image is used, most of auxiliary charge current components become excessive current components and pass through the photoconductive layer of the photosensitive drum 1 without contributing to electricity removal of the memory area, and these excessive current components promote conduction degradation of the photosensitive drum 1.

Figure 21:
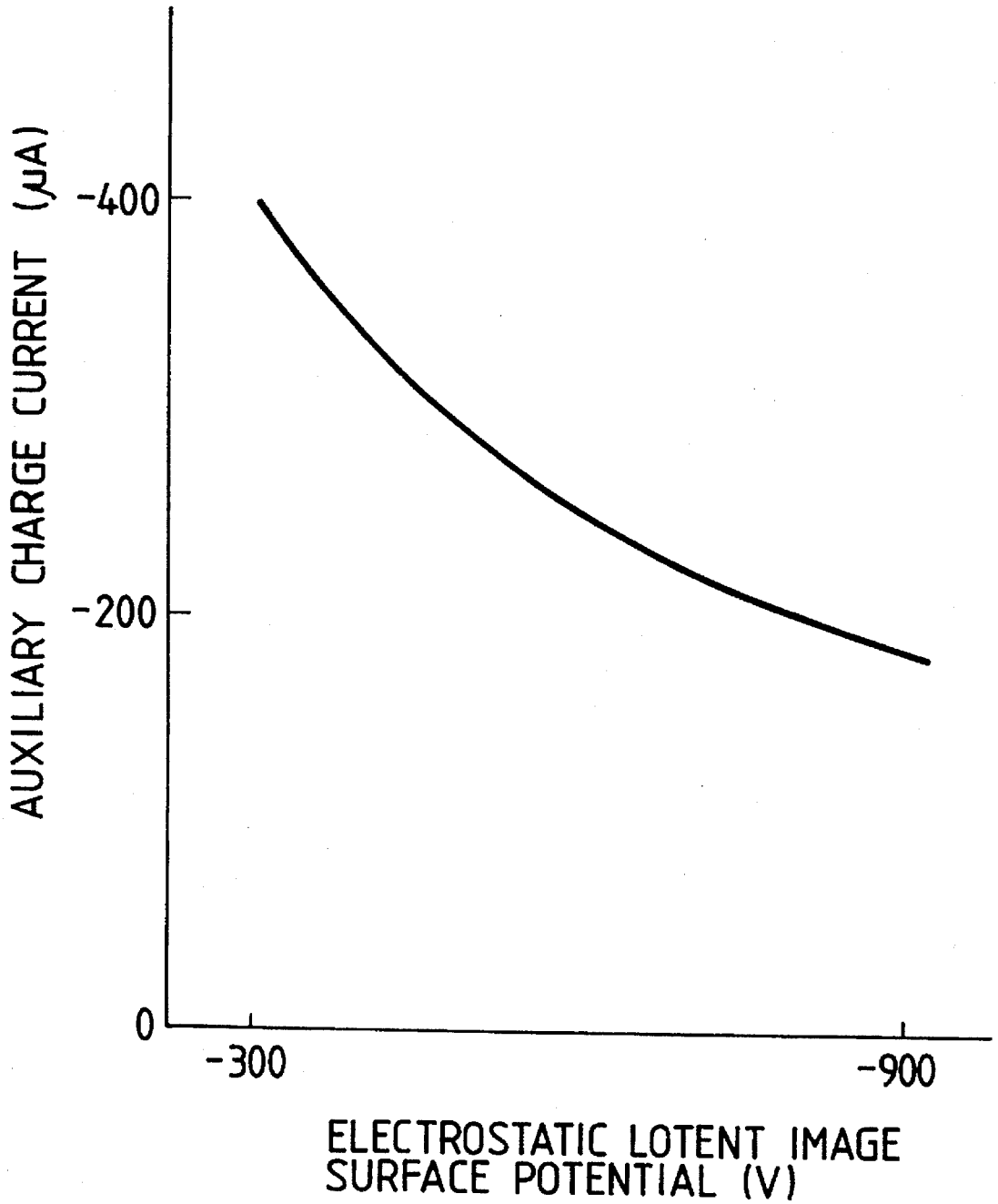
FIG. 21 is a graph showing the control value of the auxiliary charge current as a function of the surface potential of an electrostatic latent image in the seventh embodiment of an image forming apparatus according to the present invention.

Thus, in this embodiment, in order to suppress the above-mentioned conduction degradation of the photosensitive drum 1 caused by the excessive current, the charge current of the auxiliary charger 8 is controlled on the basis of the surface potential (dark potential) by the primary charge process before generation of a memory. FIG. 21 shows the control value of the auxiliary charge current corresponding to the surface potential (dark potential) of an electrostatic latent image in this embodiment.

In this embodiment, since the charge current of the auxiliary charger 8 is controlled to have a value required and sufficient for achieving electricity removal of the memory, as shown in FIG. 21, the above-mentioned conduction degradation of the photosensitive drum 1 can be greatly eliminated. More specifically, since most of charge current components of the auxiliary charger 8 remove positive electric charges trapped near the surface portion of the photosensitive drum 1, the conduction degradation of the photosensitive drum 1 due to the charge current does not easily occur.

Furthermore, in this embodiment, since the charge current of the auxiliary charger 8 is controlled on the basis of the surface potential by the primary charge process, production of discharge products such as $O_3$, $NO_x$, and the like can be eliminated to about ⅓ to ¼ as compared to a case wherein the charge condition is fixed at a charge current value for electricity removal of the maximum memory area.

As described above, according to this embodiment, since the primary charge process is performed after the auxiliary charge process and full-surface exposure process of the photosensitive drum 1 are simultaneously performed, the photosensitive drum 1 can be uniformly primary-charged, thus preventing an image defect caused by a toner image formed on the memory area unlike the prior art. In addition, since the charge current of the auxiliary charger 8 is controlled on the basis of the surface potential by the primary charge process, the degradation of the photosensitive drum 1 caused by full-surface exposure performed simultaneously with the auxiliary charge process, and deterioration of image quality caused by the degradation can be remarkably suppressed. At the same time, production of discharge products such as $O_3$, $NO_x$, and the like can be eliminated. More specifically, when the charge current of the auxiliary charger 8 is not controlled, the service life of the photosensitive drum expires after the image forming process is repeated an average of about 8,000 times. Contrary to this, according to this embodiment, the service life of the photosensitive drum can be prolonged to about 12,000 times.

Eighth Embodiment

In this embodiment, in the electrophotographing apparatus shown in FIG. 8 above, the charge currents of the auxiliary chargers 18*a* to 18*d* are controlled on the basis of the surface potential by the primary charge process.

With this control, in this embodiment as well, the photosensitive drums 11*a* to 11*d* can be uniformly primary-charged to eliminate an image defect corresponding to the memory areas. Also, degradation of the photosensitive drums 11*a* to 11*d* caused by full-surface exposure to be performed simultaneously with the auxiliary charge process, and deterioration of image quality caused by the degradation can be remarkably suppressed. At the same time, production of discharge products such as $O_3$, $NO_x$, and the like can be eliminated.

Ninth Embodiment

In this embodiment, in the electrophotographing apparatus shown in FIG. 9, the same control as in the seventh and eighth embodiments is adopted. Similarly, in this embodiment as well, the photosensitive drum 31 can be uniformly primary-charged, and a high-quality image free from an image defect corresponding to a memory area can be obtained.

Also, since the charge current of the auxiliary charger 38 is controlled on the basis of the surface potential by the primary charge process, degradation of the photosensitive drum 31 caused by full-surface exposure to be performed simultaneously with the auxiliary charge process, and deterioration of image quality caused by the degradation can be remarkably suppressed. At the same time, production of discharge products such as $O_3$, $NO_x$, and the like can be eliminated.

10th Embodiment

Figure 22:
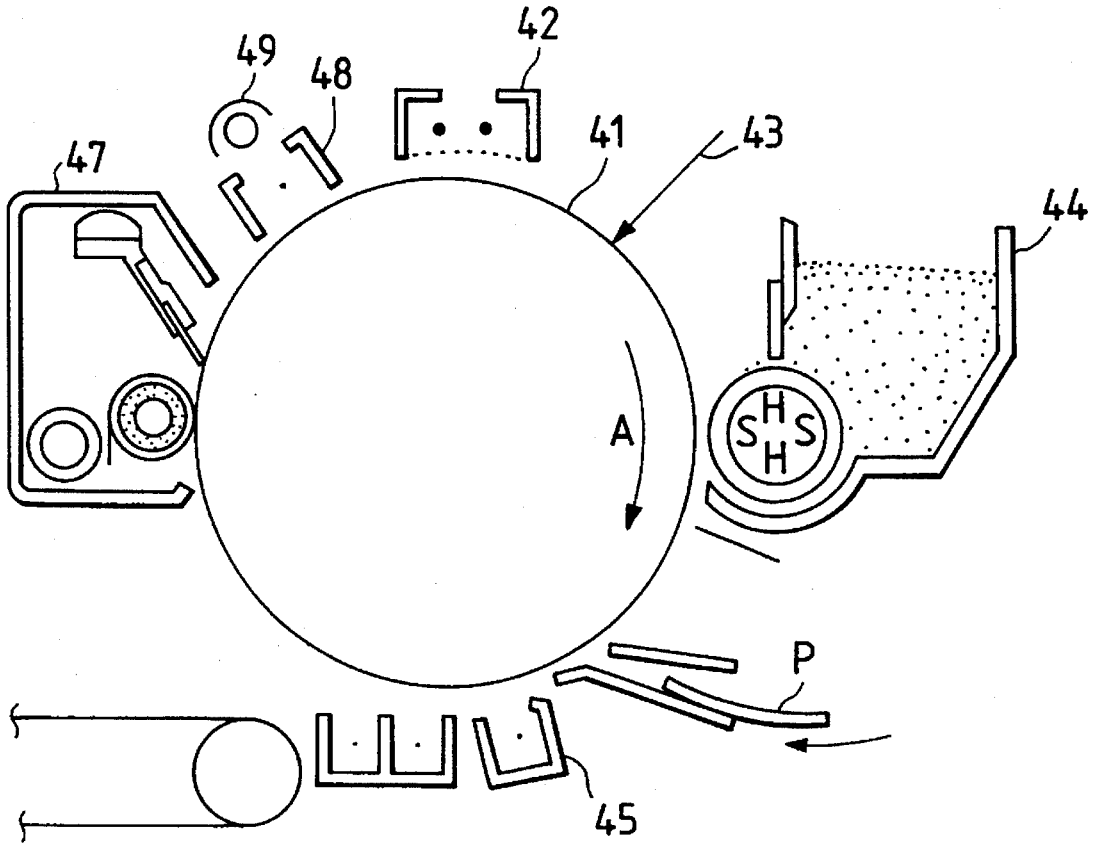
FIG. 22 is a schematic view showing the 10th embodiment of an image forming apparatus according to the present invention.

FIG. 22 is a schematic view showing the 10th embodiment of an electrophotographing apparatus according to the present invention. In the electrophotographing apparatus of this embodiment, the present invention is applied to an electrophotographing apparatus for normally developing an electrostatic latent image on a photosensitive drum by a toner having a polarity opposite to that of the photosensitive drum, e.g., an analog type monochrome electrophotography copying machine having no transfer device.

The copying machine of this embodiment comprises a photosensitive drum 41, and a primary charger 42, an exposure means 43, a developer 44, a transfer charger 45, and a cleaner 47 are arranged around the drum 41. A toner image formed by normal development on the photosensitive drum 1 upon operation of an electricity removal lamp 49, the primary charger 42, the exposure means 43, and the developer 44 is transferred onto a transfer material P fed by paper feed rollers (not shown) at a transfer portion where the transfer material P contacts the photosensitive drum 41 upon operation of the transfer charger 45.

Furthermore, an auxiliary charger 48 and the electricity removal lamp 49 which are used for simultaneously performing the charge and full-surface exposure processes of the photosensitive drum 41 are arranged at an identical position on the surface of the photosensitive drum 41 to vertically overlap each other.

In this embodiment as well, after the residual toner on the surface of the photosensitive drum 41 is removed by the cleaner 47, the photosensitive drum 41 is charged by the auxiliary charger 48 to have the same polarity (i.e., negative polarity) as that of an electrostatic latent image formed thereon, and at the same time, is uniformly exposed by the electricity removal lamp 49, so that both the memory area and the normal area are subjected to electricity removal to have a surface potential of about 0 V. Thereafter, a toner image formed on the photosensitive drum 41 upon operation of the primary charger 42, the laser beam scanner (exposure means) 43, and the developer 44 is transferred onto the fed transfer material P at the transfer portion where the transfer material P contacts the photosensitive drum 41 upon operation of the transfer charger 45.

In this embodiment as well, since the photosensitive drum 41 can be uniformly primary-charged, a high-quality image free from an image defect corresponding to a memory area unlike the prior art can be obtained. Furthermore, since the charge current of the auxiliary charger 48 is controlled on the basis of the surface potential by the primary charge process, degradation of the photosensitive drum 41 caused by full-surface exposure performed simultaneously with the auxiliary charge process, and deterioration of image quality caused by the degradation can be remarkably suppressed. At the same time, production of discharge products such as $O_3$, $NO_x$, and the like can be eliminated.

As described above, according to the seventh to 10th embodiments, since the primary charge process is performed after the auxiliary charge process and the full-surface exposure process of a photosensitive body are simultaneously performed, the photosensitive body can be uniformly primary-charged, and an image defect caused by a toner image formed on a memory area can be prevented. Also, since the charge current of the primary charge process is controlled on the basis of the surface potential by the primary charge process, the degradation of the photosensitive body caused by the full-surface exposure performed simultaneously with the auxiliary charge process, and deterioration of image quality caused by the degradation can be remarkably suppressed. At the same time, production of discharge products such as $O_3$, $NO_x$, and the like can be suppressed, and exposure and degradation of the photosensitive body caused by the discharge products, pollution of the environment due to the discharge products, and the like can be eliminated.

11th Embodiment

In this embodiment, upon removal of the memory by the auxiliary charge process, the charge condition of the auxiliary charge process is controlled on the basis of the environmental state, thereby suppressing production of discharge products such as $O_3$, $NO_x$, and the like, and eliminating exposure and degradation of the photosensitive body caused by the discharge products, pollution of the environment due to the discharge products, and the like. In this embodiment, the present invention is applied to the electrophotographing apparatus shown in FIG. 1 above.

This embodiment will be described in detail below.

Figure 23:
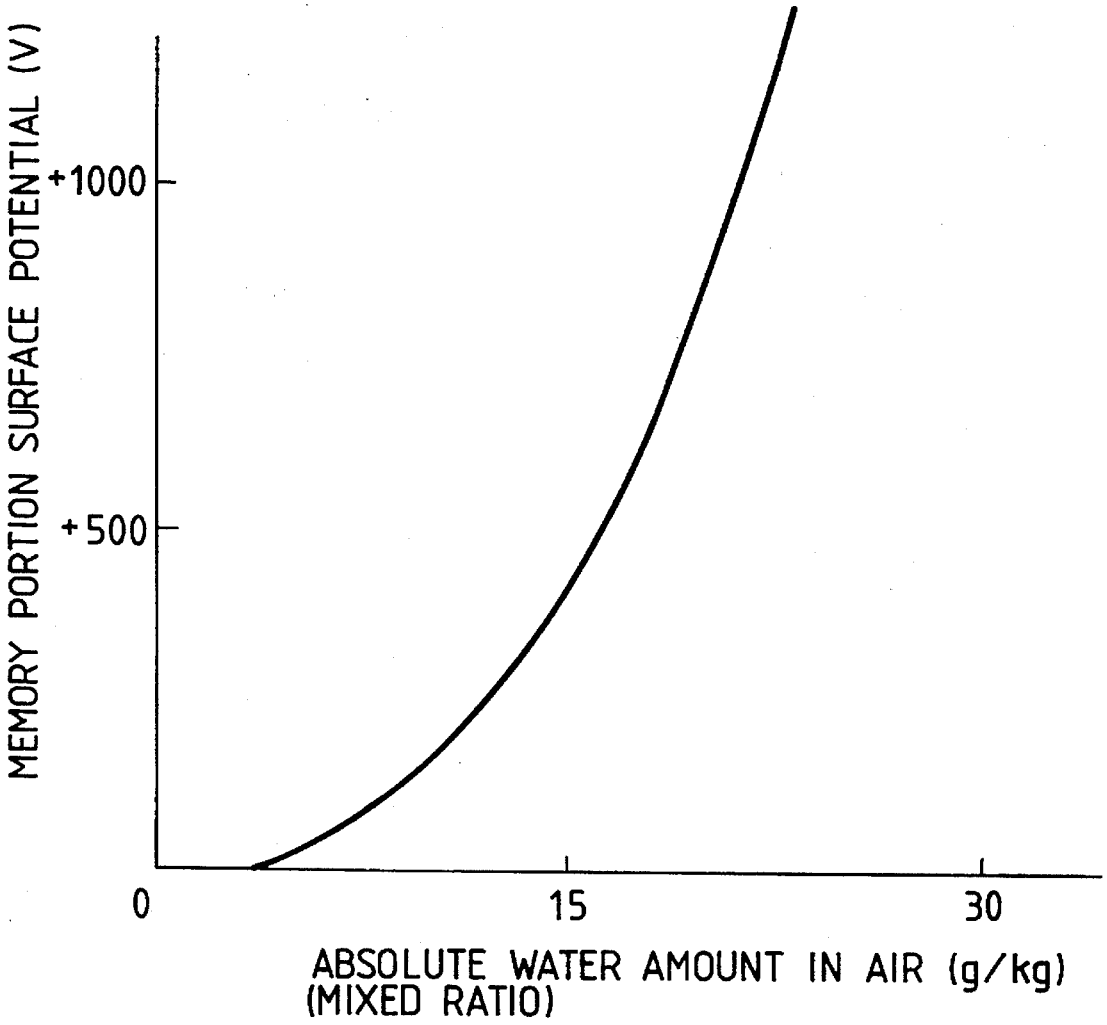
FIG. 23 is a graph showing the relationship between the absolute water amount in the air and the surface potential on the memory area of the photosensitive drum.

According to the experiments and studies of the present inventors, it was found that a potential drift caused by the memory generated on the photosensitive drum 1 after the transfer process considerably changed depending on the environmental state. For example, FIG. 23 shows the relationship between the absolute water amount in the air (mixed ratio, i.e., the amount (g) of water contained per 1 kg of air) and the surface potential on the memory area of the photosensitive drum 1. As can be understood from FIG. 23, a potential drift caused the memory generated on the photosensitive drum 1 has different magnitudes depending on the absolute water amount in the air. More specifically, as is apparent from FIG. 23, the surface potential on the memory area of the photosensitive drum 1 becomes higher (stronger) as the absolute water amount in the air increases.

Such a phenomenon occurs mainly depending on the moisture absorption state of a sheet used as the transfer material. The resistance of a sheet changes depending on the moisture absorption state of the sheet. For example, when the transfer current remains the same, if the moisture absorption amount of the sheet is large, the resistance of the sheet decreases, and as a result, the memory becomes strong. Contrary to this, if the moisture absorption amount is small, the resistance of the sheet increases, and as a result, the memory becomes weak.

As shown in FIG. 6 above, as the memory area becomes stronger, i.e., as the surface potential of the memory area has positive polarity as a polarity opposite to the normal charge polarity and is higher, the charge current of the auxiliary charger 8 required for attaining electricity removal of the memory area increases.

However, when the charge condition of the auxiliary charger 8 is fixed without being controlled, in order to remove charges on a memory area in, e.g., a high-humidity environment, the charge current value (auxiliary charge current value) of the auxiliary charger 8 must always be set to be −400 μA. When such a current value is set, if the surface potential of the photosensitive drum 1 does not suffer any memory in a low-humidity environment, most of auxiliary charge current components become excessive current components and pass through the photoconductive layer of the photosensitive drum 1 without contributing to electricity removal of the memory area, and these excessive current components promote conduction degradation of the photosensitive drum 1.

Figure 24:
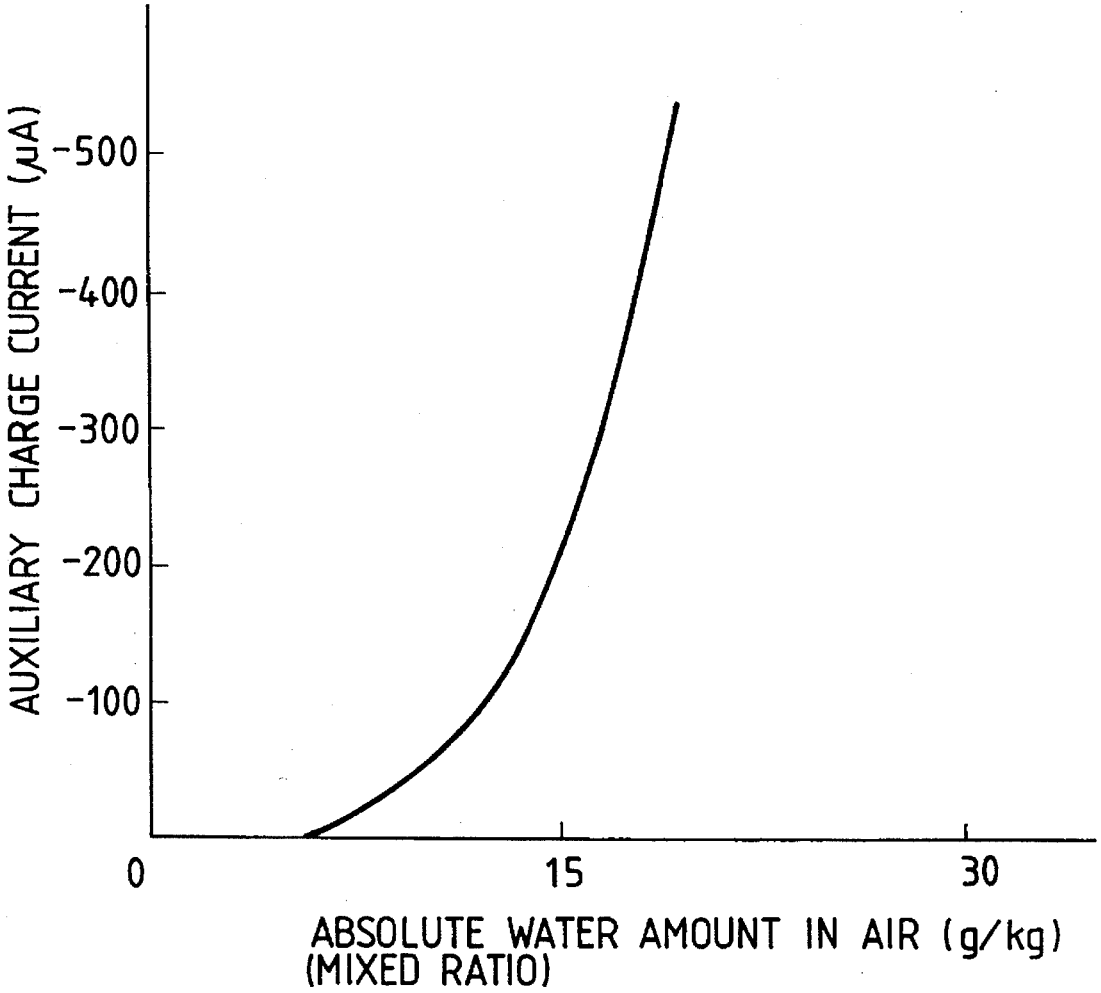
FIG. 24 is a graph showing the control value of the auxiliary charge current as a function of the absolute water amount in the air in the 11th embodiment of an image forming apparatus according to the present invention.

Thus, in this embodiment, in order to suppress the above-mentioned conduction degradation of the photosensitive drum 1 caused by the excessive current, the charge current of the auxiliary charger 8 is controlled on the basis of the environmental state, i.e., the absolute water amount in the air. More specifically, a humidity sensor (not shown) is arranged near the photosensitive drum 1 of the image forming apparatus shown in FIG. 1 to detect the absolute water amount in the air, and the charge current of the auxiliary charger 8 is controlled on the basis of the output value from this sensor. FIG. 24 shows the control value of the auxiliary charge current corresponding to the absolute water amount in the air in this embodiment.

In this embodiment, since the charge current of the auxiliary charger 8 is controlled to have a value required and sufficient for achieving electricity removal of the memory, as shown in FIG. 24, the above-mentioned conduction degradation of the photosensitive drum 1 can be greatly eliminated. More specifically, since most of charge current components of the auxiliary charger 8 remove positive electric charges trapped near the surface portion of the photosensitive drum 1, the conduction degradation of the photosensitive drum 1 due to the charge current does not easily occur. Furthermore, since the charge current of the auxiliary charger 8 is controlled to have a value required and sufficient for electricity removal of the memory, production of discharge products such as $O_3$, $NO_x$, and the like can be eliminated to about ½ to ¼ as compared to a case wherein the charge condition is fixed at a charge current value for electricity removal of the maximum memory area.

As described above, according to this embodiment, since the primary charge process is performed after the auxiliary charge process and full-surface exposure process of the photosensitive drum 1 are simultaneously performed, the photosensitive drum 1 can be uniformly primary-charged, thus preventing an image defect caused by a toner image formed on the memory area unlike the prior art. In addition, since the charge current of the auxiliary charger 8 is controlled on the basis of the environmental state, the degradation of the photosensitive drum 1 caused by full-surface exposure performed simultaneously with the auxiliary charge process, and deterioration of image quality caused by the degradation can be remarkably suppressed. At the same time, production of discharge products such as $O_3$, $NO_x$, and the like can be eliminated. More specifically, when the charge current of the auxiliary charger 8 is not controlled, the service life of the photosensitive drum expires after the image forming process is repeated an average of about 8,000 times. Contrary to this, according to this embodiment, the service life of the photosensitive drum can be prolonged to about 12,000 times.

12th Embodiment

In this embodiment, in the electrophotographing apparatus shown in FIG. 8 above, the charge currents of the auxiliary chargers 18*a* to 18*d* are controlled on the basis of the environmental state.

In this embodiment as well, the photosensitive drums 11*a* to 11*d* can be uniformly primary-charged to obtain a high-quality image free from an image defect corresponding to the memory areas. Also, degradation of the photosensitive drums 11*a* to 11*d* caused by full-surface exposure to be performed simultaneously with the auxiliary charge process, and deterioration of image quality caused by the degradation can be remarkably suppressed. At the same time, production of discharge products such as $O_3$, $NO_x$, and the like can be eliminated.

In this case, in the image forming apparatus having a plurality of image forming units, since the exhaust amounts of $O_3$, $NO_x$, and the like tend to be larger than those of an image forming apparatus comprising a single image forming unit, elimination of production of discharge products such as $O_3$, $NO_x$, and the like as in this embodiment is particularly effective.

13th Embodiment

In this embodiment, the same control as in the 11th and 12th embodiments is adopted in the electrophotographing apparatus shown in FIG. 9 above.

In this embodiment as well, since the photosensitive drum 31 can be uniformly primary-charged, a high-quality image free from an image defect corresponding to a memory area unlike in the prior art can be obtained. Since the charge current of the auxiliary charger 38 is controlled on the basis of the environmental state, degradation of the photosensitive drum 31 caused by full-surface exposure to be performed simultaneously with the auxiliary charge process, and deterioration of image quality caused by the degradation can be remarkably suppressed. At the same time, production of discharge products such as $O_3$, $NO_x$, and the like can be eliminated.

14th Embodiment

In this embodiment, the present invention is applied to the electrophotography apparatus shown in FIG. 22 above. The electrophotography apparatus shown in FIG. 22 is an electrophotography apparatus for normally developing an electrostatic latent image on a photosensitive drum by a toner having a polarity opposite to that of the photosensitive drum, e.g., an analog type monochrome electrophotography copying machine having no transfer device such as a transfer drum and a transfer belt. In this embodiment as well, the same control as in the 11th to 13th embodiments is adopted.

In this embodiment as well, since the photosensitive drum 41 can be uniformly primary-charged, a high-quality image free from an image defect corresponding to a memory area unlike in the prior art can be obtained. Since the charge current of the auxiliary charger 48 is controlled on the basis of the environmental state, degradation of the photosensitive drum 41 and an increase in exhaust amount of discharge products such as $O_3$, $NO_x$, and the like due to addition of the auxiliary charger 48 can be minimized.

As described above, according to each of the 11th to 14th embodiments, since the primary charge process is performed after the auxiliary charge process and the full-surface exposure process of a photosensitive body are simultaneously performed, the photosensitive body can be uniformly primary-charged, and an image defect caused by a toner image formed on a memory area can be prevented. Also, since the charge current of the primary charge process is controlled on the basis of the environmental condition, the degradation of the photosensitive body caused by the full-surface exposure performed simultaneously with the auxiliary charge process, and deterioration of image quality caused by the degradation can be remarkably suppressed. At the same time, production of discharge products such as $O_3$, $NO_x$, and the like can be suppressed, and exposure and degradation of the photosensitive body caused by the discharge products, pollution of the environment due to the discharge products, and the like can be eliminated.

In each of the above embodiments, in place of controlling the charge current of the auxiliary charger 8 or the like, the voltage to be applied to the lamp 9 or the like may be controlled.

In each of the above embodiments, the transfer means is not limited to a corona discharger. For example, a brush-shaped or blade-shaped charger, which contacts the rear side of the sheet 501 or the belt 17 and is applied with a transfer voltage, may be used.

As described above, according to the electrophotography apparatus of the present invention, in order to eliminate a memory generated on a photosensitive body due to peeling discharge caused by accumulation of electric charges on the surface of a transfer material, in particular, accumulation of electric charges on the end portion of the transfer material, the first charge process and the full-surface exposure process are simultaneously performed on the photosensitive body, and the second charge process having the same polarity as that of the first charge process is performed on the photosensitive body to uniformly charge the surface of the photosensitive body at a desired potential. Thereafter, the surface of the photosensitive body is exposed in correspondence with an image pattern to form an electrostatic latent image, and the latent image is developed by a developing agent to be visualized as a toner image. For this reason, the memory area on the photosensitive body can be prevented from being developed and transferred onto the transfer material unlike in the prior art. Therefore, a high-quality image free from an image defect or image nonuniformity caused by the memory area can be obtained without causing adverse influences such as a cleaning error, dielectric breakdown of the photosensitive body, and the like.

Furthermore, since the first charge condition is controlled to have a value required and sufficient for removing the memory on the basis of one of the transfer condition of the transfer means, the type of the transfer material, the surface potential of the photosensitive body by the primary charge process, and the environmental condition such as the humidity in the air, production of discharge products such as $O_3$, $NO_x$, and the like by the first charge process can be suppressed, and exposure and degradation of the photosensitive body caused by the discharge products, pollution of the environment due to the discharge products, and the like can be eliminated.

The present invention is not limited to the above embodiments, and various other modifications may be made within the technical scope of the invention.

What is claimed is:

1. An electrophotographic apparatus, comprising:

a photosensitive body;

first charge means for performing a first charge process to form an image on said photosensitive body, said first charge means having a polarity;

transfer charge means for transferring the image formed on said photosensitive body onto a transfer material, said transfer charge means being applied a current of opposite polarity to the charge polarity of said first charge means; and potential applying means for setting said photosensitive body at a predetermined potential after the image is transferred by said transfer charge means and before a next first charge process is performed by said first charge means, said potential applying means comprising second charge means, to which a DC voltage of the same polarity as the charge polarity of said first charge means is applied for charging said photosensitive body at the charge position, and exposure means for exposing said photosensitive body at the charge position, wherein the charging by said second charge means and the exposure by said exposure means are performed simultaneously.

2. An electrophotography apparatus according to claim 1, wherein charging of said second charge means is controlled based on an image forming condition on the transfer material.

3. An electrophotography apparatus according to claim 1, wherein the exposure by said exposure means is controlled based on an image forming condition on the transfer material.

4. An electrophotography apparatus according to claim 2 or 3, wherein the image forming condition is a transfer condition for transfer onto the transfer material by said transfer charge means.

5. An electrophotography apparatus according to claim 4, wherein the transfer condition is a current amount applied to said transfer charge means.

6. An electrophotography apparatus according to claim 1, wherein a current amount applied to said second charge means is controlled based on an image forming condition on the transfer material.

7. An electrophotography apparatus according to claim 1, wherein charging by said second charge means is controlled based on a type of the transfer material on which the image is to be transferred.

8. An apparatus according to claim 7, wherein the type of the transfer material is a thickness or a material of the transfer material.

9. An electrophotography apparatus according to claim 1, wherein a current amount applied to said second charge means is controlled based on a type of the transfer material on which the image is to be transferred.

10. An electrophotography apparatus according to claim 1, wherein charging by said second charge means is controlled based on a dark potential of said photosensitive body before the image is transferred.

11. An electrophotography apparatus according to claim 1, wherein exposure by said exposure means is controlled based on a dark potential of said photosensitive body before the image is transferred.

12. An electrophotography apparatus according to claim 1, wherein a current amount applied to said second charge means is controlled based on a dark potential of said photosensitive body before the image is transferred.

13. An electrophotography apparatus according to claim 1, wherein charging by said charge means is controlled based on an environmental condition.

14. An electrophotography apparatus according to claim 1, wherein an exposure ability of said exposure means is controlled based on an environmental condition.

15. An electrophotography apparatus according to claim 13 or 14, wherein the environmental condition is at least one of a temperature and a humidity.

16. An electrophotography apparatus according to one of claims 1, 2, 3, 7, 10, 11, 12 and 13, further comprising image exposure means for exposing an image on said photosensitive body charged by said first charge to thereby form an electrostatic latent image on said photosensitive body; and developing means for developing the electrostatic latent image with a toner, wherein a toner image formed on said photosensitive body is transferred onto the transfer material by said transfer charge means.

17. An electrophotography apparatus according to one of claims 1, 2, 3, 7, 10, 11, 12 and 13, further comprising a dielectric sheet for carrying the transfer material, and said transfer charge means electrostatically transfer the image onto the transfer material carried on said dielectric sheet.

18. An electrophotography apparatus according to claim 17, wherein plural images are super-imposedly transferred onto the transfer material carried on the dielectric sheet.

* * * * *

UNITED STATES PATENT AND TRADEMARK OFFICE

CERTIFICATE OF CORRECTION

PATENT NO. : 5,512,983

DATED : April 30, 1996

INVENTOR(S) : Fukushima et al.

It is certified that error appears in the above-indentified patent and that said Letters Patent is hereby corrected as shown below:

On the title page , item

[54]

Change "ELECTROPHOTOGRAPHING" to --ELECTROPHOTOGRAPHY--.

[57] ABSTRACT

Line 3, change "devices" to --device--.

In the Drawing

SHEET 16 - FIG 21

Change "LOTENT" to --LATENT--.

COLUMN 1

Line 1, change "ELECTROPHOTOGRAPHING" to --ELECTROPHOTOGRAPHY--.

COLUMN 12

Line 14, change "vertical" to --vertically--.

COLUMN 23

Line 17, change "electrophotographic" to --electrophotography--.

Signed and Sealed this

Twenty-ninth Day of April, 1997

*Attest:*

*Attesting Officer*

Bruce Lehman

BRUCE LEHMAN

*Commissioner of Patents and Trademarks*